US007502002B2

(12) United States Patent
Horiuchi et al.

(10) Patent No.: US 7,502,002 B2
(45) Date of Patent: Mar. 10, 2009

(54) PIXEL CIRCUIT, ELECTRO-OPTICAL DEVICE, AND ELECTRONIC APPARATUS

(75) Inventors: Hiroshi Horiuchi, Matsumoto (JP); Hiroaki Jo, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 644 days.

(21) Appl. No.: 10/969,850

(22) Filed: Oct. 22, 2004

(65) Prior Publication Data

US 2005/0122052 A1 Jun. 9, 2005

(30) Foreign Application Priority Data

Nov. 20, 2003 (JP) ..... 2003-390678
Nov. 26, 2003 (JP) ..... 2003-395609
Nov. 26, 2003 (JP) ..... 2003-395610
Aug. 3, 2004 (JP) ..... 2004-226364

(51) Int. Cl.
*G09G 3/32* (2006.01)
*G09G 3/30* (2006.01)

(52) U.S. Cl. ..... 345/82; 345/76; 315/169.3

(58) Field of Classification Search ..... 345/76–83, 345/36, 44–46; 315/169.3; 313/463
See application file for complete search history.

(56) References Cited

U.S. PATENT DOCUMENTS 6,859,193 B1 * 2/2005 Yumoto ..... 345/82
7,193,591 B2 3/2007 Yumoto
2002/0033718 A1 3/2002 Tam
2002/0196212 A1 * 12/2002 Nishitoba et al. ..... 345/76
2003/0062524 A1 * 4/2003 Kimura ..... 257/72
2004/0207615 A1 10/2004 Yumoto
2005/0190177 A1 9/2005 Yumoto

FOREIGN PATENT DOCUMENTS

JP A-2003-22049 1/2003
WO WO 01/06484 A1 1/2001

* cited by examiner

*Primary Examiner*—Jimmy H Nguyen
(74) *Attorney, Agent, or Firm*—Oliff & Berridge, PLC

(57) ABSTRACT

To accurately display a predetermined gray level. A first transistor T1 and a second transistor T2 are arranged in a first path 501 from a power line 41 to a constant-current circuit 301. A driving transistor Tdr and a current supply transistor Tc are arranged in a second path 502 from the power line 41 to an OLED element 51. A capacitor C1 connected to the gate of the driving transistor and a capacitor C2 connected to the gate of the current supply transistor Tc hold a voltage corresponding to a data current Idata-j flowing in the first path 501. The driving transistor Tdr controls a driving current flowing in the second path 502 in accordance with the voltage held in the capacitor C1. The current supply transistor Tc controls the driving current flowing in the second path 502 in accordance with the voltage held in the capacitor C2.

5 Claims, 15 Drawing Sheets

PIXEL CIRCUIT, ELECTRO-OPTICAL DEVICE, AND ELECTRONIC APPARATUS

BACKGROUND OF THE INVENTION

1. Field of Invention

The present invention relates to technologies for displaying images using electro-optical elements, such as organic light-emitting diode (hereinafter, referred to as an OLED) elements.

2. Description of Related Art

Active-matrix devices including thin-film transistors provided for respective pixels in order to control currents supplied to electro-optical elements have been suggested as electro-optical devices for displaying images using electro-optical elements. However, devices of this type have a problem of display unevenness caused by variation in characteristics (for example, a threshold voltage) of the thin-film transistors.

In order to solve the problem, for example, patent document 1 discloses a pixel circuit shown in FIG. 16. As shown in FIG. 16, in a pixel circuit 8, a driving transistor 82 and a lighting control transistor 83 are arranged in a path from a power line 80 to which a high-potential voltage Vdd of a power supply is applied to an OLED element 81. The driving transistor 82 controls a current Ic (hereinafter, referred to as a "driving current Ic") supplied to the OLED element 81, and the lighting control transistor 83 controls a period during which the OLED element 81 emits light. The pixel circuit 8 also includes a transistor 85 for diode-connecting the gate and the drain of the driving transistor 82, a transistor 87 arranged in a path from the driving transistor 82 to a constant-current source 86, and a capacitor 88 whose one end is connected to the gate of the driving transistor 82. With this arrangement, first, the transistor 85 that is turned on due to application of a voltage VP causes the driving transistor 82 to be diode-connected, and a current Idata (hereinafter, referred to as a "data current Idata") corresponding to a desired gray level flows in a path from the power line 80 to the constant-current source 86 via the driving transistor 82 and the turned-on transistor 87. Here, the gate voltage of the driving transistor 82 corresponding to the data current Idata is held in the capacitor 88. Second, the lighting control transistor 83 is turned on due to application of a voltage VR when the transistors 85 and 87 are turned off, and the driving current Ic corresponding to the voltage held immediately before in the capacitor 88 flows into the OLED element 81 via the driving transistor 82 and the lighting control transistor 83.

[Patent Document 1] Japanese Unexamined Patent Application Publication No. 2003-22049 (see FIG. 17)

SUMMARY OF THE INVENTION

However, in the arrangement shown in FIG. 16, the driving current Ic flowing in the OLED element 81 may be different from a desired current. The present inventor has found that one of the causes of an error of the driving current Ic is that a ratio between the data current Idata and the driving current Ic (hereinafter, referred to as an "input-to-output current ratio") depends on the drain voltage Vd of the driving transistor 82. FIG. 17 is a graph showing the relationship between the drain voltage Vd of the driving transistor 82 and the input-to-output current ratio M (=driving current Ic/data current Idata) in the arrangement shown in FIG. 16. As shown in FIG. 17, the input-to-output current ratio M varies in accordance with the drain voltage Vd of the driving transistor 82 under the influence of a channel length modulation effect (Early effect). Thus, although the data current Idata is equal to the driving current Ic (in other words, the input-to-output current ratio M is "1") when the drain voltage Vd of the driving transistor 82 is V1, when the drain voltage Vd is changed to V2, which is larger than V1, the driving current Ic becomes larger than the data current Idata and the OLED element 81 emits light at a luminance higher than an intended luminance (the luminance assumed to be achieved when the data current Idata flows in the OLED element 81). As described above, according to the known technology, an intended luminance designated by the data current Idata is different from the actual luminance of the OLED element 81, and this causes a reduction in the display quality. The present invention is designed with respect to such circumstances, and an object of the present invention is to accurately display a desired gray level.

In order to achieve the above object, according to a first aspect of the present invention, a pixel circuit (see FIGS. 3 and 4) includes a first path from a power supply to a current source; a second path from the power supply to an electro-optical element; a first transistor arranged in the first path and diode-connected; a voltage holding element for holding a voltage corresponding to a data current flowing in the first path; a driving transistor for controlling a driving current flowing in the second path in accordance with the voltage held in the voltage holding element connected to the gate of the driving transistor, the driving transistor being arranged in the second path, the gate of the driving transistor also being connected to the gate of the first transistor; and maintaining means for maintaining a ratio between the data current and the driving current substantially constant, irrespective of the voltage of the electro-optical element. With this arrangement, since the ratio between the data current and the driving current (input-to-output current ratio M) is maintained substantially constant, irrespective of the voltage of the electro-optical element, the optical operation (for example, light emission at a particular luminance) designated to the electro-optical element by the data current is approximately equal to an actual optical operation of the electro-optical element corresponding to the driving current. Thus, a desired gray level can be accurately displayed. Here, the electro-optical element converts current into an optical operation, such as a luminance (the amount of light emission) or transmittance. A typical electro-optical element is, for example, an organic light-emitting diode (OLED) element, such as an organic electro luminescent (EL) or a light-emitting polymer.

According to a second aspect of the present invention, a pixel circuit (see FIGS. 3 and 4) includes a first path from a power supply to a current source; a second path from the power supply to an electro-optical element; a first transistor (corresponding to a transistor T1 in FIGS. 3 and 4) arranged in the first path and diode-connected; a first voltage holding element (corresponding to a capacitor C1 in FIGS. 3 and 4) for holding a voltage corresponding to a data current flowing in the first path; a driving transistor (corresponding to a driving transistor Tdr in FIGS. 3 and 4) for controlling a driving current flowing in the second path in accordance with the voltage held in the first voltage holding element connected to the gate of the driving transistor, the driving transistor being arranged in the second path, the gate of the driving transistor also being connected to the gate of the first transistor; a second transistor (corresponding to a transistor T2 in FIGS. 3 and 4) arranged in the first path and diode-connected; a second voltage holding element (corresponding to a capacitor C2 in FIGS. 3 and 4) for holding a voltage corresponding to the data current flowing in the first path; and a current supply transistor (corresponding to a current supply transistor Tc in FIGS. 3 and 4) for controlling the driving current flowing in the second path in accordance with the voltage held in the second voltage holding element connected to the gate of the current supply transistor, the current supply transistor being arranged in the second path, the gate of the current supply transistor also being connected to the gate of the second transistor. The pixel circuit includes a so-called cascode current mirror circuit.

In this arrangement, the driving transistor and the current supply transistor arranged in the second path are cascode-connected. Thus, even if the drain voltage of the current supply transistor (and, furthermore, the voltage of the electro-optical element) changes, the drain current of the driving transistor is maintained substantially constant, and the current flowing from the driving transistor into the current supply transistor (that is, the driving current) is also maintained substantially constant. In other words, cascode-connecting the current supply transistor and the driving transistor substantially increases the resistance across these transistors, compared with a case where only a driving transistor is provided in the second path. Thus, according to the present invention, the influence of the channel length modulation effect can be reduced, and the input-to-output current ratio can be maintained substantially constant. As a result of this, the optical operation (for example, light emission at a particular luminance) designated to the electro-optical element by the data current is approximately equal to an actual optical operation of the electro-optical element corresponding to the driving current. Thus, a desired gray level can be accurately displayed.

Although a cascode current mirror circuit is adopted here, means for maintaining the input-to-output current ratio substantially constant, irrespective of the voltage of an electro-optical element, is not limited to this. For example, the means for maintaining the input-to-output current ratio may be a circuit, such as a Wilson current mirror circuit or a wide swing cascode current mirror circuit. A pixel circuit according to a third or fourth aspect of the present invention described below adopts a Wilson current mirror circuit, and a pixel circuit according to a fifth or sixth aspect of the present invention described below adopts a wide swing cascode current mirror circuit.

According to a third aspect of the present invention, a pixel circuit (see FIGS. 5 and 7) includes a first path from a power supply to a current source; a second path from the power supply to an electro-optical element; a first transistor (corresponding to a transistor T1 in FIGS. 5 and 7) arranged in the first path; a first voltage holding element (corresponding to a capacitor C1 in FIGS. 5 and 7) for holding a voltage corresponding to a data current flowing in the first path; a driving transistor (corresponding to a driving transistor Tdr in FIGS. 5 and 7) for controlling a driving current flowing in the second path in accordance with the voltage held in the first voltage holding element connected to the gate of the driving transistor, the driving transistor being arranged in the second path and being diode-connected, the gate of the driving transistor also being connected to the gate of the first transistor; a second voltage holding element (corresponding to a capacitor C2 in FIGS. 5 and 7) for holding a voltage corresponding to the data current flowing in the first path; and a current supply transistor (corresponding to a current supply transistor Tc in FIGS. 5 and 7) for controlling the driving current flowing in the second path in accordance with the voltage held in the second voltage holding element connected to the gate of the current supply transistor, the current supply transistor being arranged in the second path, the gate of the current supply transistor also being connected to the first path.

In this arrangement, the driving transistor and the current supply transistor arranged in the second path are cascode-connected. Thus, even if the drain voltage of the current supply transistor (and, furthermore, the voltage of the electro-optical element) changes, the drain current of the driving transistor is maintained substantially constant, and the current flowing from the driving transistor into the current supply transistor (that is, the driving current) is also maintained substantially constant. In other words, cascode-connecting the driving transistor and the current supply transistor substantially increases the resistance across these transistors, compared with a case where only a driving transistor is provided. Thus, according to the present invention, the influence of the channel length modulation effect can be reduced, and the input-to-output current ratio can be maintained substantially constant. As a result of this, the optical operation (for example, light emission at a particular luminance) designated to the electro-optical element by the data current is approximately equal to an actual optical operation of the electro-optical element corresponding to the driving current. Thus, a desired gray level can be accurately displayed.

According to a fourth aspect of the present invention, a pixel circuit (see FIGS. 6 and 8) includes a first path from a power supply to a current source; a second path from the power supply to an electro-optical element; a first transistor (corresponding to a transistor T1 in FIGS. 6 and 8) arranged in the first path; a first voltage holding element (corresponding to a capacitor C1 in FIGS. 6 and 8) for holding a voltage corresponding to a data current flowing in the first path; a driving transistor (corresponding to a driving transistor Tdr in FIGS. 6 and 8) for controlling a driving current flowing in the second path in accordance with the voltage held in the first voltage holding element connected to the gate of the driving transistor, the driving transistor being arranged in the second path and being diode-connected, the gate of the driving transistor also being connected to the gate of the first transistor; a second voltage holding element (corresponding to a capacitor C2 in FIGS. 6 and 8) for holding a voltage corresponding to the data current flowing in the first path; a second transistor (corresponding to a transistor T2 in FIGS. 6 and 8) arranged in the first path and diode-connected; and a current supply transistor (corresponding to a current supply transistor Tc in FIGS. 6 and 8) for controlling the driving current flowing in the second path in accordance with the voltage held in the second voltage holding element connected to the gate of the current supply transistor, the current supply transistor being arranged in the second path, the gate of the current supply transistor also being connected to the gate of the second transistor. With this arrangement, as in the pixel circuit according to the third aspect of the present invention, the ratio between the data current and the driving current (the input-to-output current ratio M) is maintained substantially constant, irrespective of the drain voltage of the current supply transistor (that is, the voltage of the electro-optical element). Thus, the optical operation (for example, light emission at a particular luminance) designated to the electro-optical element by the data current is approximately equal to an actual optical operation of the electro-optical element corresponding to the driving current. Therefore, a desired gray level can be accurately displayed.

According to a fifth aspect of the present invention, a pixel circuit (see FIGS. 9 to 11) includes a first path from a power supply to a current source: a second path from the power supply to an electro-optical element; a first transistor (corresponding to a transistor T1 in FIGS. 9 to 11) arranged in the first path; a first voltage holding element (corresponding to a capacitor C1 in FIGS. 9 to 11) for holding a voltage corresponding to a data current flowing in the first path; a driving transistor (corresponding to a driving transistor Tdr in FIGS. 9 to 11) for controlling a driving current flowing in the second path in accordance with the voltage held in the first voltage holding element connected to the gate of the driving transistor, the driving transistor being arranged in the second path, the gate of the driving transistor also being connected to the gate of the first transistor; a second transistor (corresponding to a transistor T2 in FIGS. 9 to 11) arranged in the first path, the drain of the second transistor being connected to the gate of the first transistor; a second voltage holding element (corresponding to a capacitor C2 in FIGS. 9 to 11) for holding a voltage corresponding to the data current flowing in the first path; a current supply transistor (corresponding to a current supply transistor TC in FIGS. 9 to 11) for controlling the driving current flowing in the second path in accordance with the voltage held in the second voltage holding element connected to the gate of the current supply transistor, the current supply transistor being arranged in the second path, the gate of the current supply transistor also being connected to the gate of the second transistor; and a bias circuit for applying a bias voltage to the gate of the current supply transistor. The transistors in the pixel circuit constitute a cascode current mirror circuit (in particular, may be referred to as a wide swing cascode current mirror circuit).

In this arrangement, as in the first to fourth aspects of the present invention, the driving transistor and the current supply transistor arranged in the second path are cascode-connected. Thus, even if the drain voltage of the current supply transistor (and, furthermore, the voltage of the electro-optical element) changes, the drain current of the driving transistor is maintained substantially constant, and the current flowing from the driving transistor into the current supply transistor (that is, the driving current) is also maintained substantially constant. In other words, cascode-connecting the driving transistor and the current supply transistor substantially increases the resistance across these transistors, compared with a case where only a driving transistor is provided. Thus, according to the present invention, the influence of the channel length modulation effect can be reduced, and the input-to-output current ratio can be maintained substantially constant. As a result of this, the optical operation (for example, light emission at a particular luminance) designated to the electro-optical element by the data current is approximately equal to an actual optical operation of the electro-optical element corresponding to the driving current. Thus, a desired gray level can be accurately displayed.

According to a sixth aspect of the present invention, a pixel circuit (see FIG. 12) includes a first path from a power supply to a current source; a second path from the power supply to an electro-optical element; a first transistor (corresponding to a transistor T1 in FIG. 12) arranged in the first path and diode-connected; a first voltage holding element (corresponding to a capacitor C1 in FIG. 12) for holding a voltage corresponding to a data current flowing in the first path; a driving transistor (corresponding to a driving transistor Tdr in FIG. 12) for controlling a driving current flowing in the second path in accordance with the voltage held in the first voltage holding element connected to the gate of the driving transistor, the driving transistor being arranged in the second path, the gate of the driving transistor also being connected to the gate of the first transistor; a second transistor (corresponding to a transistor T2 in FIG. 12) arranged in the first path; a second voltage holding element (corresponding to a capacitor C2 in FIG. 12) for holding a voltage corresponding to the data current flowing in the first path; a current supply transistor (corresponding to a current supply transistor Tc in FIG. 12) for controlling the driving current flowing in the second path in accordance with the voltage held in the second voltage holding element connected to the gate of the current supply transistor, the current supply transistor being arranged in the second path, the gate of the current supply transistor also being connected to the gate of the second transistor; and a bias circuit for applying a bias voltage to the gate of the current supply transistor. In this arrangement, as in the fifth aspect of the present invention, the transistors constitute a cascode current mirror circuit (in particular, may be referred to as a wide swing cascode current mirror circuit). Thus, even if the drain voltage of the current supply transistor changes, the drain current of the driving transistor is maintained substantially constant, and the current flowing from the driving transistor into the current supply transistor (that is, the driving current) is also maintained substantially constant.

In the cascode current mirror circuit like the pixel circuit according to the fifth or sixth aspect of the present invention, all the transistors operate in a saturation region. Thus, the pixel circuit according to the aspect requires a high power supply voltage. Thus, the need for a reduction in power consumption may be prevented. In order to solve this problem, the pixel circuit according to the fifth or sixth aspect of the present invention includes a bias circuit for applying a bias voltage to the gate of the current supply transistor. Since applying the bias voltage to the gate of the current supply transistor reduces the drain voltage of the current supply transistor, a power supply voltage required for driving the pixel circuit can be reduced.

More specifically, the bias circuit includes a bias transistor (corresponding to a bias transistor Tb in FIGS. 9 to 12) that is arranged in a third path provided between the power supply and another power supply and that is diode-connected, the gate of the bias transistor being connected to the gate of the current supply transistor. With this arrangement, the gate voltage of the bias transistor is applied as a bias voltage to the gate of the current supply transistor.

The pixel circuit according to any one of the first to sixth aspects of the present invention includes means (corresponding to, for example, a transistor 511 in FIG. 3, a transistor 521 in FIG. 5, or a transistor 532 in FIG. 9) for causing the gate of the driving transistor to be in a floating state and means (corresponding to, for example, a transistor 512 in FIG. 3, a transistor 522 in FIG. 5, or a transistor 531 in FIG. 9) for causing the gate of the current supply transistor to be in the floating state. With this arrangement, the means for causing the gate of the driving transistor to be in the floating state and the means for causing the gate of the current supply transistor to be in the floating state can cause the pixel circuit to operate or not to operate as a current mirror circuit (a cascode type or a Wilson type). Thus, for example, power consumption can be reduced by causing the current mirror circuit to operate only during a period (a write period in the embodiments) at which a voltage corresponding to a data current is held in the first and second voltage holding elements.

An electro-optical device according to the present invention includes a plurality of pixel circuits described above arranged in a planer fashion (for example, in a matrix fashion). As described above, since the pixel circuit according to the present invention is capable of causing a desired driving current to flow to the electro-optical element with high accuracy, an electro-optical device having a desired gradation characteristic with high display quality is provided. The electro-optical device according to the present invention can be adopted as a display device for an electronic apparatus.

In the electro-optical device including the plurality of pixel circuits according to the fifth or six aspect of the present invention, the bias circuit may be commonly used for the plurality of pixel circuits, instead of being provided for each of the pixel circuits. More specifically, an electro-optical device includes a plurality of pixel circuits according to the fifth aspect of the present invention arranged in a planar fashion and a bias circuit commonly used for the plurality of pixel circuits and supplying a bias voltage to the plurality of pixel circuits. Each of the plurality of pixel circuits includes a first path from a power supply to a current source; a second path from the power supply to an electro-optical element; a first transistor arranged in the first path; a first voltage holding element for holding a voltage corresponding to a data current flowing in the first path; a driving transistor for controlling a driving current flowing in the second path in accordance with the voltage held in the first voltage holding element connected to the gate of the driving transistor, the driving transistor being arranged in the second path, the gate of the driving transistor also being connected to the gate of the first transistor; a second transistor arranged in the first path, the drain of the second transistor being connected to the gate of the first transistor; a second voltage holding element for holding a voltage corresponding to the data current flowing in the first path; and a current supply transistor for controlling the driving current flowing in the second path in accordance with the voltage held in the second voltage holding element connected to the gate of the current supply transistor, the current supply transistor being arranged in the second path, the gate of the current supply transistor also being connected to the gate of the second transistor. With this arrangement, the bias circuit is commonly used for driving the plurality of pixel circuits. Thus, a simpler arrangement and a reduction in the production cost can be achieved compared with an arrangement in which a bias circuit is provided for each of pixel circuits.

In contrast, an electro-optical device includes a plurality of pixel circuits according to the sixth aspect of the present invention arranged in a planar fashion and a bias circuit commonly used for the plurality of pixel circuits and supplying a bias voltage to the plurality of pixel circuits. Each of the plurality of pixel circuits includes a first path from a power supply to a current source; a second path from the power supply to an electro-optical element; a first transistor arranged in the first path and diode-connected; a first voltage holding element for holding a voltage corresponding to a data current flowing in the first path; a driving transistor for controlling a driving current flowing in the second path in accordance with the voltage held in the first voltage holding element connected to the gate of the driving transistor, the driving transistor being arranged in the second path, the gate of the driving transistor also being connected to the gate of the first transistor; a second transistor arranged in the first path; a second voltage holding element for holding a voltage corresponding to the data current flowing in the first path; and a current supply transistor for controlling the driving current flowing in the second path in accordance with the voltage held in the second voltage holding element connected to the gate of the current supply transistor, the current supply transistor being arranged in the second path, the gate of the current supply transistor also being connected to the gate of the second transistor. With this arrangement, the bias circuit is commonly used for driving the plurality of pixel circuits. Thus, a simpler arrangement and a reduction in the production cost can be achieved compared with an arrangement in which a bias circuit is provided for each of pixel circuits.

DETAILED DESCRIPTION OF PREFERRED EMBODIMENTS

Embodiments of the present invention will be described with reference to the drawings. An electro-optical device according to each of the embodiments described below displays images having a plurality of gray levels by OLED elements, which are electro-optical elements.

A: Arrangement of Electro-Optical Device

Figure 1:
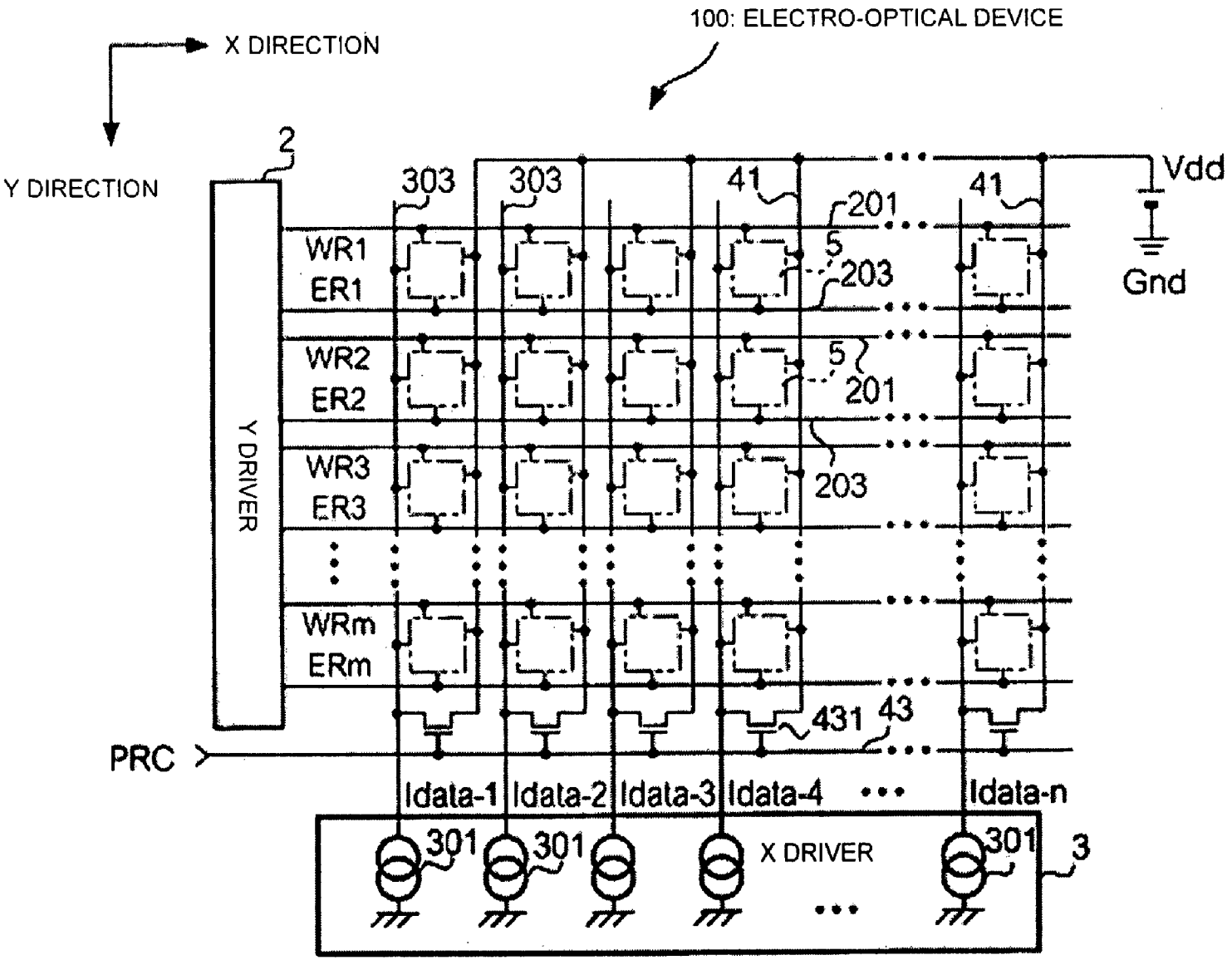
FIG. 1 is a block diagram showing the entire arrangement of an electro-optical device according to embodiments of the present invention.

A specific example of an electro-optical device 100 according to the present invention will be described with reference to FIG. 1. As shown in FIG. 1, the electro-optical device 100 includes m selection lines 201 extending in an X direction and n data lines 303 extending in a Y direction. Pixel circuits 5 are arranged at intersections of the selection lines 201 and the data lines 303. Accordingly, the pixel circuits 5 are arranged in a matrix of m Rows×n columns in the X and Y directions. The pixel circuits 5 are connected to power lines 41 to which a high-potential voltage Vdd of a power supply is applied and to power lines (not shown) to which a low-potential voltage Gnd of the power supply is applied.

Figure 2:
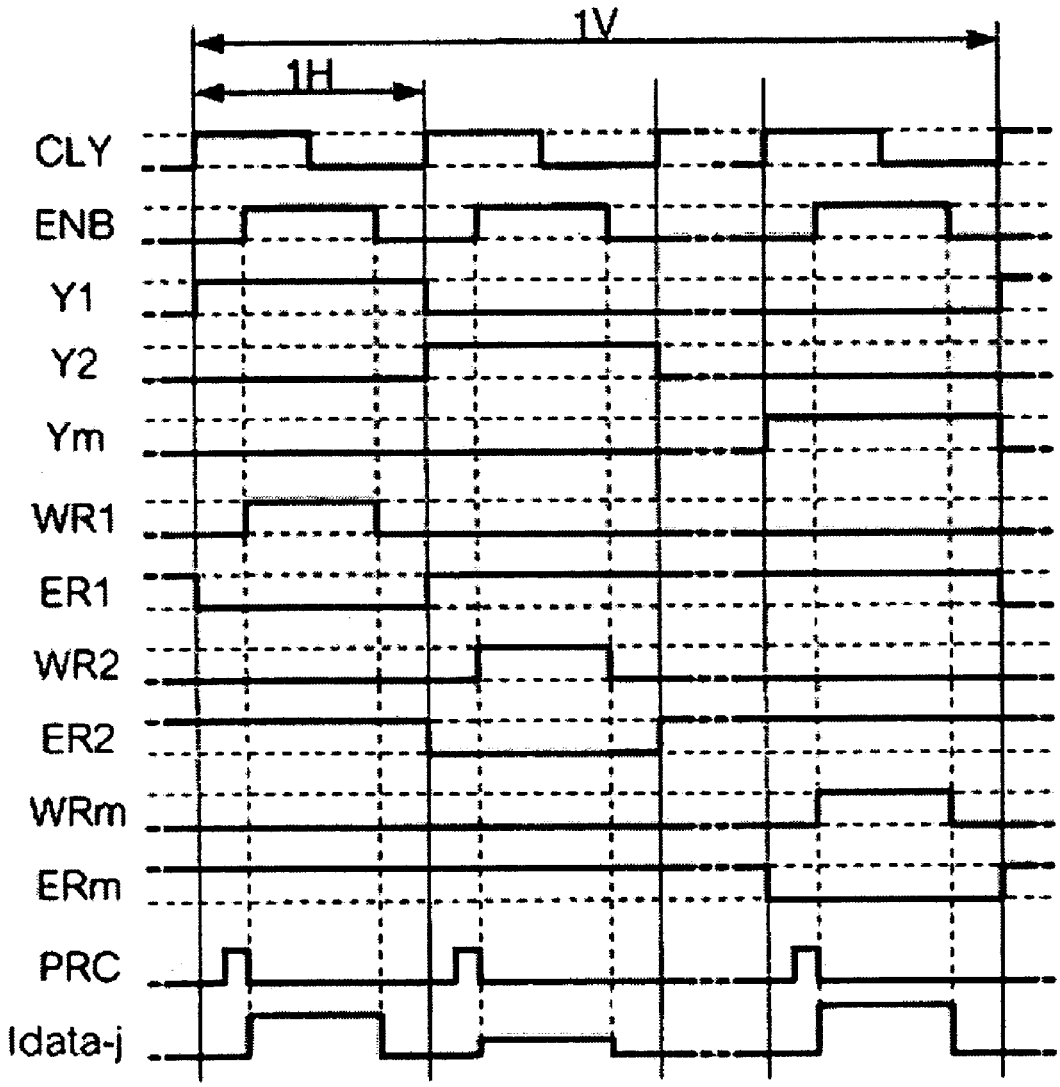
FIG. 2 is a timing chart showing a waveform of each signal in the electro-optical device.

The electro-optical device 100 also includes m lighting control lines 203 extending in the X direction so as to be parallel to the selection lines 201. A pair of each of the selection lines 201 and each of adjacent lighting control lines 203 is commonly used to control n pixel circuits 5 that belong to each row. The selection lines 201 and the lighting control lines 203 are connected to a Y driver (a scanning line driving circuit) 2. The Y driver 2 changes write signals WR1, WR2, . . . , and WRm supplied to the m selection lines 201 to an active level (H level) in order for each horizontal scanning period (1H). In more detail, as shown in FIG. 2, the Y driver 2 sequentially shifts a pulse signal supplied at the beginning of each vertical scanning period (1V) in accordance with a clock signal CLY having a period corresponding to one horizontal scanning period to generate selection signals Y1, Y2, . . . , and Ym, and outputs logical products of the selection signals Y1, Y2, . . . , and Ym and an enable signal ENB to the selection lines 201 as the write signals WR1, WR2, . . . , and WRm. The enable signal ENB rises at a point in time when predetermined time passes from the beginning of each of the horizontal scanning period, and falls the predetermined time before the end of each of the horizontal scanning period. Furthermore, the Y driver 2 outputs signals obtained by inverting the levels of the selection signals Y1, Y2, . . . , and Ym to the lighting control lines 203 as lighting control signals ER1, ER2, . . . , and ERm.

In contrast, as shown in FIG. 1, the data lines 303 are connected to an X driver (a data line driving circuit) 3. The X driver 3 includes constant-current circuits 301 provided for the respective data lines 303. The constant-current circuits 301 cause data currents Idata corresponding to image data designating gray levels of respective images to flow in the corresponding data lines 303 at a period (hereinafter, referred to as a write period) during which the corresponding write signals WR1, WR2, . . . , and WRm supplied to the selection lines 201 are at an active level. For example, as shown in FIG. 2, a constant-current circuit 301 connected to a j-th (is a natural number satisfying the condition $1 \leqq j \leqq n$) data line 303 causes a data current Idata-j corresponding to image data for a pixel circuit 5 of i-th row and j-th column to flow in the corresponding data line 303 at a period during which a write signal WRi supplied to an i-th (i is a natural number satisfying the condition $1 \leqq i \leqq m$) selection line 201 is an active level.

Also, as shown in FIG. 1, the data lines 303 are connected to the drains of n-channel transistors 431 provided for the respective data lines 303. The sources of the transistors 431 are connected to the power lines 41, and the gates of the transistors 431 are connected to a common pre-charge control line 43. A pre-charge control signal PRC is supplied to the pre-charge control line 43. As shown in FIG. 2, the pre-charge control signal PRC becomes active immediately before the write period of each horizontal scanning period. Since the pre-charge control signal PRC causes all the transistors 431 to be turned on, all the data lines 303 are pre-charged to the voltage Vdd together before the write period.

B: Arrangement of Pixel Circuit

A specific circuit arrangement of the pixel circuits 5 of the electro-optical device 100 shown in FIG. 1 will now be described.

B-1a: First Embodiment

Figure 3:
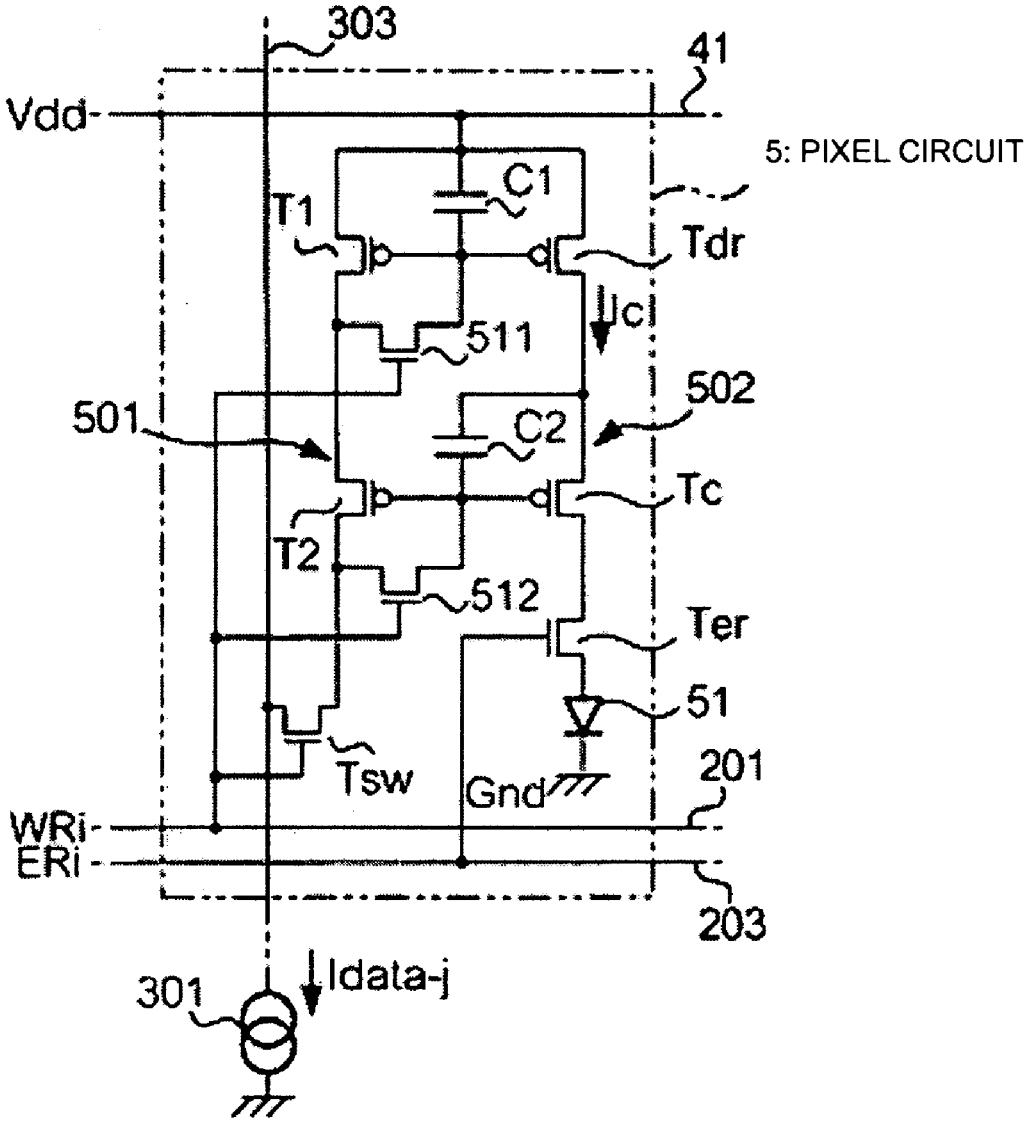
FIG. 3 is a circuit diagram showing the arrangement of a pixel circuit according to a first embodiment of the present invention.

The arrangement of pixel circuits 5 according to a first embodiment of the present invention will be described with reference to FIG. 3. Although only one pixel circuit 5 in the i-th row and the j-th column is illustrated in FIG. 3, other pixel circuits 5 have a similar arrangement. As shown in FIG. 3, the pixel circuit 5 includes an OLED element 51, which is an electro-optical element; transistors Tdr, Tc, Ter, Tsw, T1, T2, 511, and 512; and capacitors C1 and C2 functioning as voltage holding elements. Each of the transistors constituting the pixel circuit 5 is a thin-film transistor made by a polysilicon process. The transistors Tdr, Tc, T1, and T2 are p-channel transistors, and the transistors Ter, Tsw, 511, and 512 are n-channel transistors. The conduction type of each of the transistors constituting the pixel circuit 5 may be appropriately changed. Also, the transistors Tdr, Tc, T1, and T2 have approximately the same transistor size (channel width and channel length).

The transistor Ter (hereinafter, may be referred to as "a lighting control transistor") defines a period during which the OLED element 51 is actually turned on and is arranged in a path 502 (corresponding to a "second path" in the present invention) from the power line 41, to which the high-potential voltage Vdd of the power supply is supplied, to the OLED element 51. More specifically, the source of the lighting control transistor Ter is connected to the anode of the OLED element 51, and the gate of the lighting control transistor Ter is connected to the lighting control line 203. The cathode of the OLED element 51 is grounded at the low-potential voltage Gnd of the power supply. Also, the transistor Tdr (hereinafter, may be referred to as a "driving transistor") and the transistor Tc (hereinafter, may be referred to as a "current supply transistor") are arranged in the path 502. The driving transistor Tdr and the current supply transistor Tc control a driving current Ic flowing in the OLED element 51. The drain of the current supply transistor Tc is connected to the drain of the lighting control transistor Ter, and the source of the current supply transistor Tc is connected to the drain of the driving transistor Tdr. The source of the driving transistor Tdr is connected to the power line 41. Accordingly, the driving transistor Tdr, the current supply transistor Tc, and the lighting control transistor Ter are arranged in that order in the path 502, which is from the power line 41 to the OLED element 51, when viewed from the power line 41.

In contrast, the transistor Tsw (hereinafter, may be referred to as a "switching transistor") is arranged in a path 501 (corresponding to a first path in the present invention) from the power line 41 to the data line 303. The drain of the switching transistor Tsw is connected to the drain of the transistor T2. The gate of the transistor T2 is connected to the gate of the current supply transistor Tc, and the source of the transistor T2 is connected to the drain of the transistor T1. The gate of the transistor T1 is connected to the gate of the driving transistor Tdr, and the source of the transistor T1 is connected to the power line 41. Accordingly, the transistor T1, the transistor T2, and the switching transistor Tsw are arranged in that order in the path 501, which is from the power line 41 to the data line 303 (and further to the constant-current circuit 301), when viewed from the power line 41.

The capacitors C1 and C2 are elements for holding a voltage corresponding to a data current Idata-j flowing to the constant-current circuit 301 from the power line 41 via the path 501 and the data line 303. The capacitor Cl is an element for holding the gate voltage of the transistor T1. One end of the capacitor C1 is connected to the gate of the transistor T1 and the gate of the driving transistor Tdr, and the other end of the capacitor C1 is connected to the power line 41. The capacitor C2 is an element for holding the gate voltage of the transistor T2. One end of the transistor T2 is connected to the gate of the transistor T2 and the gate of the current supply transistor Tc, and the other end of the capacitor C2 is connected to the source of the current supply transistor Tc.

The transistor 511 is a switching element for electrically connecting or disconnecting the gate and the drain of the transistor T1 in accordance with a write signal WRi. Similarly, the transistor 512 is a switching element for electrically connecting or disconnecting the gate and the drain of the transistor T2 in accordance with the write signal WRi. The gate of each of the transistors 511 and 512 is connected to the selection line 201. When the transistors 511 and 512 are turned on, each of the transistor T1 and T2 is diode-connected. As described above, the pixel circuit 5 has an arrangement in which a current mirror circuit in which the gate of the transistor T2 is connected to the gate of the current supply transistor Tc and the transistor T2 is diode-connected via the transistor 512 and a current mirror circuit in which the gate of the transistor T1 is connected to the gate of the driving transistor Tdr and the transistor T1 is diode-connected via the transistor 511 are cascode-connected (in other words, the pixel circuit 5 has a cascode current mirror circuit). The current mirror circuit including the transistor T2 and the current supply transistor Tc functions as means for keeping the input-to-output current ratio M substantially constant, irrespective of the drain voltage Vd of the current supply transistor Tc (and furthermore, a voltage across the OLED element 51).

With this arrangement, when the write signal WRi is shifted to an active level (H level) at a horizontal scanning period during which the i-th selection line 201 is selected, the switching transistor Tsw is turned on to electrically connect the path 501 to the data line 303, and at the same time, the transistors 511 and 512 are turned on to diode-connect each of the transistors T1 and T2. Thus, the data current Idata-j generated by the constant-current circuit 301 flows in the path 501 via the power line 41, the transistor T1, the transistor T2, the switching transistor Tsw, and the data line 303. Here, the gate voltage of the transistor T1 becomes a voltage corresponding to the data current Idata-j to be held in the capacitor C1. Similarly, the gate voltage of the transistor T2 becomes a voltage corresponding to the data current Idata-j to be held in the capacitor C2.

When the write signal WRi is shifted to an inactive level (L level), the switching transistor Tsw is turned off to electrically disconnect the path 501 and the data line 303. In contrast, the gate voltages of the driving transistor Tdr and the current supply transistor Tc are kept at a voltage corresponding to the data current Idata-j by the capacitors C1 and C2, respectively. Thus, when the lighting control signal ERi is shifted to the active level (H level) to turn on the lighting control transistor Ter, a driving current Ic corresponding to the data current Idata-j flows in the path 502 via the power line 41, the driving transistor Tdr, the current supply transistor Tc, the lighting control transistor Ter, and the OLED element 51. This causes the OLED element 51 to emit light.

Figure 14:
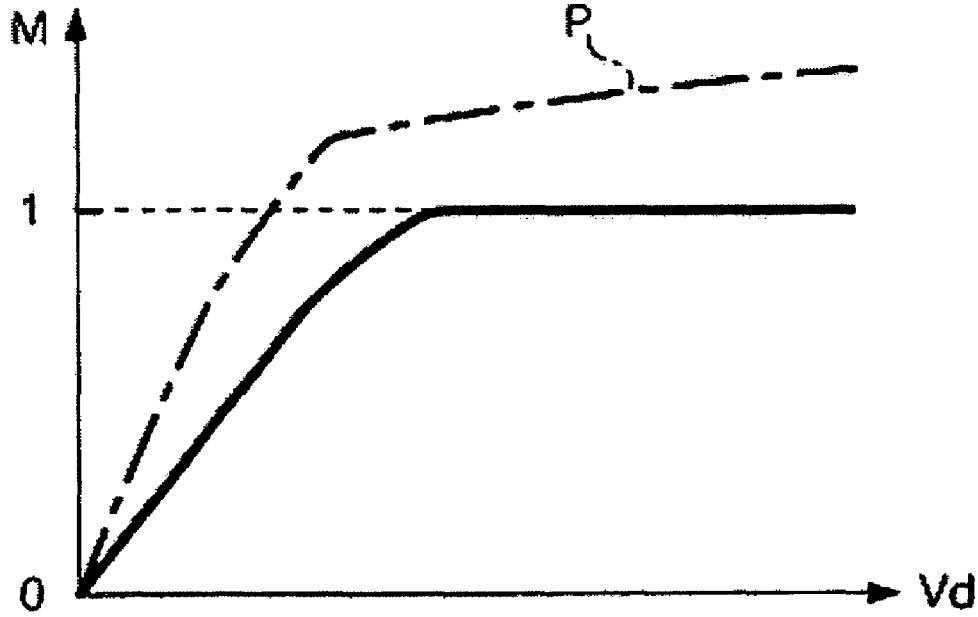
FIG. 14 is a graph showing the relationship between the drain voltage of a current supply transistor and the input-to-output current voltage.
Figure 16:
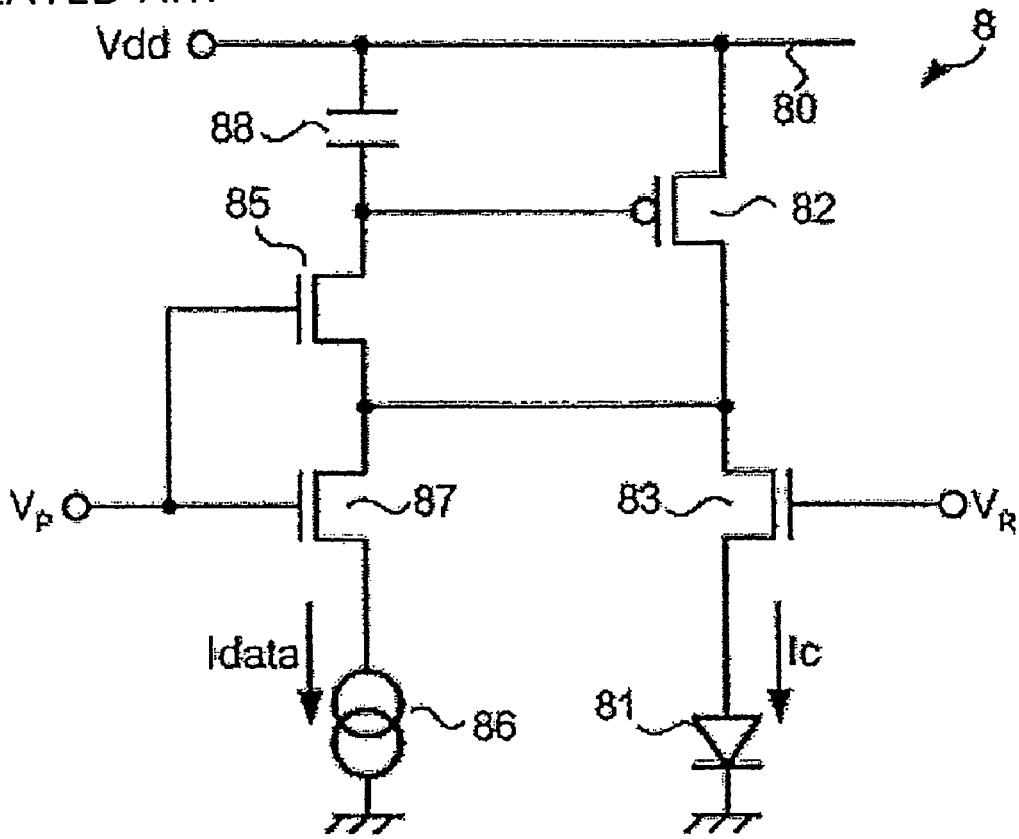
FIG.16 RELATED ART
FIG. 16 is a circuit diagram showing the arrangement of a known pixel circuit.
Figure 17:
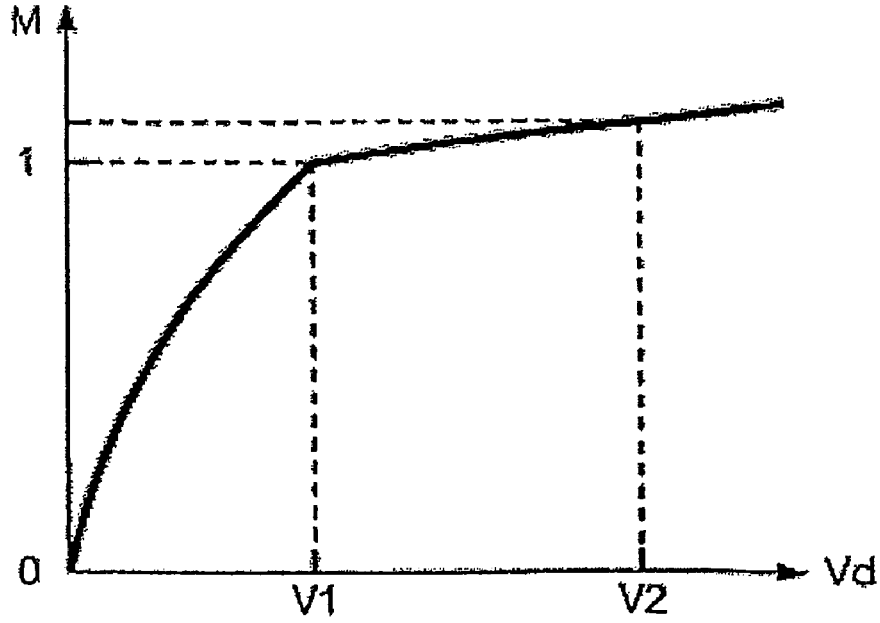
FIG.17 RELATED ART
FIG. 17 is a graph showing the relationship between the drain voltage of a driving transistor and the input-to-output current ratio in the known pixel circuit.

FIG. 14 is a graph showing the relationship between the drain voltage Vd of the current supply transistor Tc and the input-to-output current ratio M (=driving current Ic/data current Idata) in the arrangement shown in FIG. 3. In FIG. 14, the drain voltage Vd of the current supply transistor Tc is represented on the horizontal axis, and the input-to-output current ratio M is represented on the vertical axis. Also, in FIG. 14, a characteristic P of the known pixel circuit 8 shown in FIGS. 16 and 17 is represented by a one-dot chain line as a comparison example. As shown in FIG. 14, if the drain voltage Vd of the current supply transistor Tc is a predetermined value or more, the input-to-output current ratio M is kept at a constant value "1", irrespective of the drain voltage Vd of the current supply transistor Tc. In other words, the OLED element 51 is driven by a driving current Ic that is approximately equal to the data current Idata, irrespective of the drain voltage Vd of the current supply transistor Tc. Thus, according to the first embodiment, an actual luminance of the OLED element 51 is approximately equal to an intended luminance designated by the data current Idata.

B-1b: Modification of First Embodiment

Figure 4:
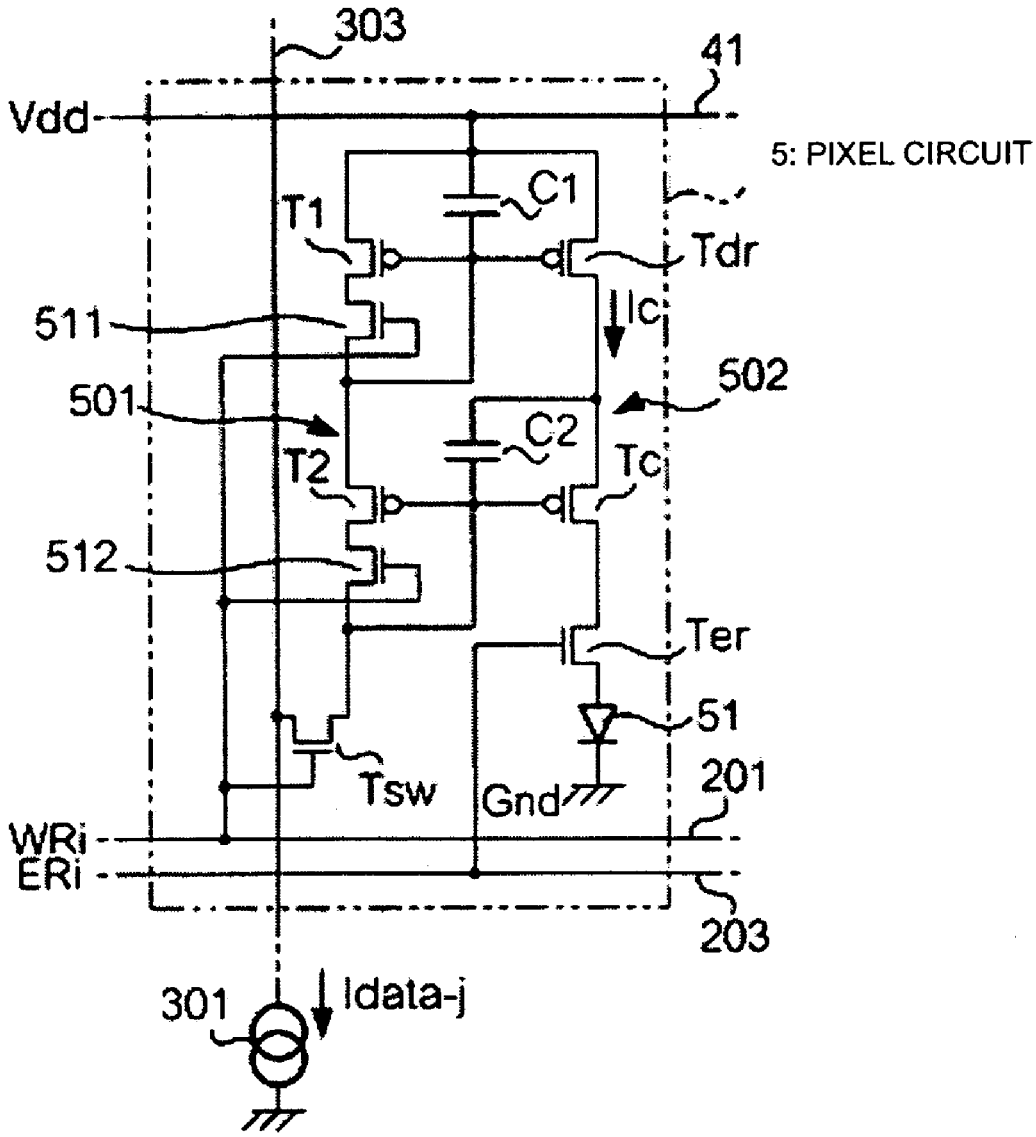
FIG. 4 is a circuit diagram showing the arrangement of a pixel circuit according to a modification of the first embodiment.

Although an arrangement in which the transistors 511 and 512 are arranged between the gate and the drain of the transistor T1 and the gate and the drain of the transistor T2, respectively, is explained in the first embodiment, an arrangement shown in FIG. 4 may be adopted, instead of the above arrangement. In the arrangement shown in FIG. 4, the transistor 511 is arranged between the transistor T1 and the transistor T2, and the gate of the transistor T1 is connected to the drain of the transistor 511. Similarly, the transistor 512 is arranged between the transistor T2 and the switching transistor Tsw, and the gate of the transistor T2 is connected to the drain of the transistor 512. Connecting the gate of each of the transistors 511 and 512 to the selection line 201 is similar to the first embodiment. With this arrangement, an effect similar to the first embodiment can be achieved. The transistors 511 and 512 according to this modification functions as means for causing the gate of the driving transistor Tdr and the gate of the current supply transistor Tc to be in a floating state.

B-2a: Second Embodiment

Figure 5:
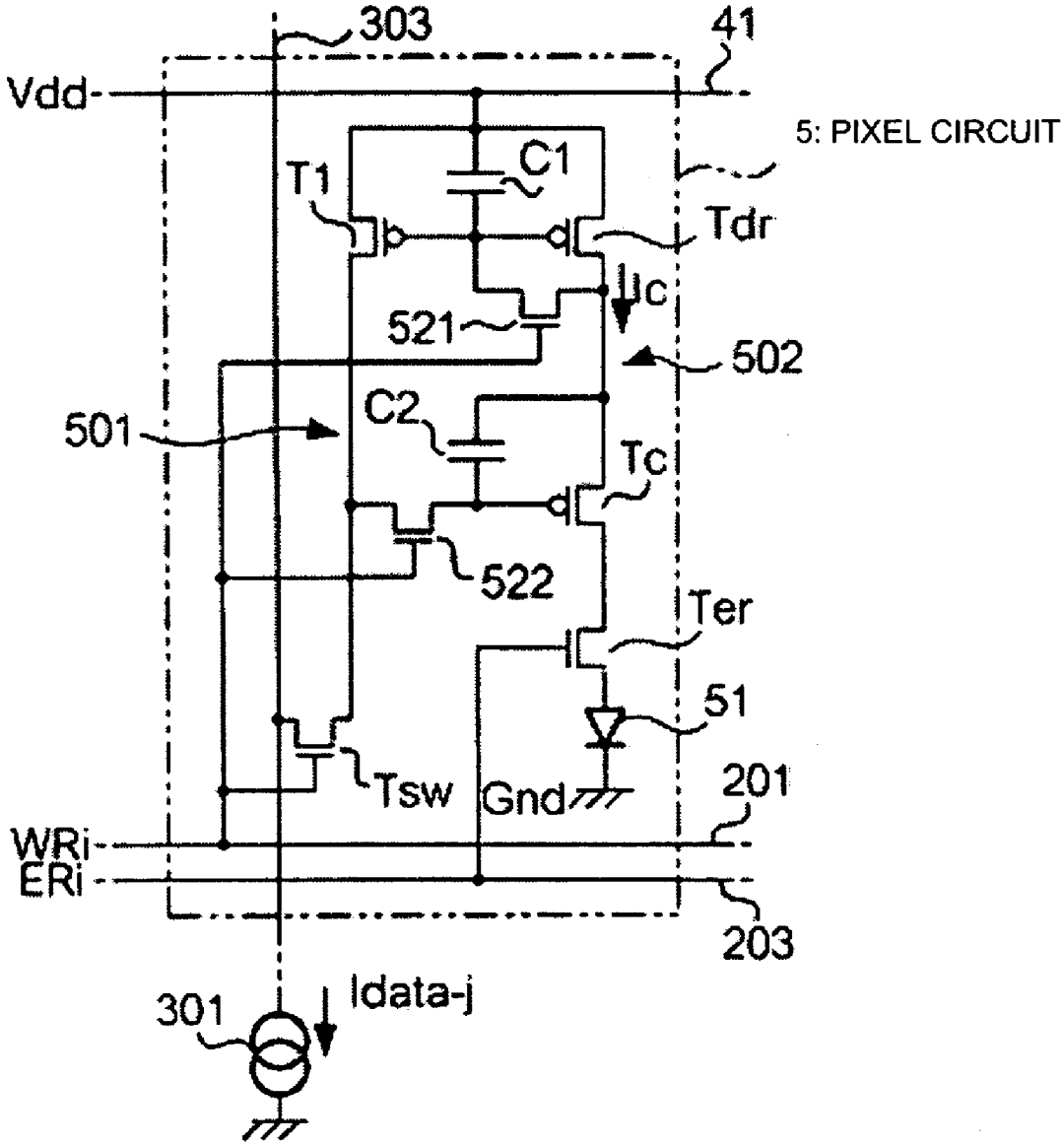
FIG. 5 is a circuit diagram showing the arrangement of a pixel circuit according to a second embodiment of the present invention.

The arrangement of pixel circuits 5 according to a second embodiment of the present invention will be described with reference to FIG. 5. Although only one pixel circuit 5 in the i-th row and the j-th column is illustrated in FIG. 5, other pixel circuits 5 have a similar arrangement. As shown in FIG. 5, the pixel circuit 5 includes the OLED element 51, which is an electro-optical element; transistors Tdr, Tc, Ter, Tsw, T1, 521, and 522; and capacitors C1 and C2 functioning as voltage holding elements. Each of the transistors constituting the pixel circuit 5 is a thin-film transistor made by a polysilicon process. The transistors Tdr, Tc, and T1 are p-channel transistors, and the transistors Ter, Tsw, 521, and 522 are n-channel transistors. The conduction type of each of the transistors constituting the pixel circuit 5 may be appropriately changed. Also, the transistors Tdr, Tc, and T1 have approximately the same transistor size (channel width and channel length).

As in the first embodiment, the lighting control transistor Ter is arranged in the path 502 from the power line 41, to which the high-potential voltage Vdd of the power supply is applied, to the OLED element 51. More specifically, the source of the lighting control transistor Ter is connected to the anode of the OLED element 51, and the gate of the lighting control transistor Ter is connected to the lighting control line 203. The cathode of the OLED element 51 is grounded at the low-potential voltage Gnd of the power supply. Also, the driving transistor Tdr and the current supply transistor Tc are arranged in the path 502. The driving transistor Tdr and the current supply transistor Tc control a driving current Ic flowing to the OLED element 5 1. The drain of the current supply transistor Tc is connected to the drain of the lighting control transistor Ter, and the source of the current supply transistor Tc is connected to the drain of the driving transistor Tdr. The source of the driving transistor Tdr is connected to the power line 41. Accordingly, the driving transistor Tdr, the current supply transistor Tc, and the lighting control transistor Ter are arranged in that order in the path 502, which is from the power line 41 to the OLED element 5 1, when viewed from the power line 41.

In contrast, the switching transistor Tsw is arranged in the path 501 from the power line 41 to the data line 303. The source of the switching transistor Tsw is connected to the data line 303, and the gate of the switching transistor Tsw is connected to the selection line 201. The drain of the switching transistor Tsw is connected to the drain of the transistor T1. The gate of the transistor T1 is connected to the gate of the driving transistor Tdr, and the source of the transistor T1 is connected to the power line 41. Accordingly, the transistor T1 and the switching transistor Tsw are arranged in the path 501, which is from the power line 41 to the data line 303.

The capacitors C1 and C2 are elements for holding a voltage corresponding to a data current Idata-j flowing to the constant-current circuit 301 from the power line 41 via the data line 303. One end of the capacitor C1 is commonly connected to the gate of the transistor T1 and the gate of the driving transistor Tdr. The other end of the capacitor C1 is connected to the source of the driving transistor Tdr (thus, to the power line 41). One end of the capacitor C2 is connected to the gate of the current supply transistor Tc, and the other end of the capacitor C2 is connected to the source of the current supply transistor Tc.

The transistor 521 is a switching element for electrically connecting or disconnecting the gate and the drain of the driving transistor Tdr in accordance with a write signal WRi. The gate of the current supply transistor Tc connected to the one end of the capacitor C2 is connected to the path 501 via the transistor 522. The transistor 522 is a switching element for electrically connecting or disconnecting the gate of the current supply transistor Tc and the path 501 in accordance with the write signal WRi. The gate of each of the transistors 521 and 522 is connected to the selection line 201.

With this arrangement, when the write signal WRi is shifted to an active level (H level) at a horizontal scanning period during which the i-th selection line 201 is selected and the transistors 521 and 522 are turned on, the driving transistor Tdr is diode-connected, and the one end of the capacitor C2 and the gate of the current supply transistor Tc are electrically connected to the path 501. Here, the data current Idata-j generated by the constant-current circuit 301 flows to the data line 303 via the path 501. Thus, the gate voltage of the transistor T1 becomes a voltage corresponding to the data current Idata-j to be held in the capacitor C1. In contrast, the gate voltage of the current supply transistor Tc becomes a voltage corresponding to the data current Idata-j to be held in the capacitor C2.

When the write signal WRi is shifted to an inactive level (L level), although the transistors 521 and 522 are turned off, the gate voltages of the driving transistor Tdr and the current supply transistor Tc are maintained by the capacitors C1 and C2, respectively. Then, after a lighting control signal ERi is shifted to an active level, the lighting control transistor Ter is turned on. Thus, the driving current Ic corresponding to the data current Idata-j flows into the OLED element 51 via the path 502. This causes the OLED element 51 to emit light.

The relationship of the drain voltage Vd of the current supply transistor Tc and the input-to-output current ratio M (=driving current Ic/data current Idata) in the second embodiment is also shown by the solid line in FIG. 14. As shown in FIG. 14, if the drain voltage Vd of the current supply transistor Tc is a predetermined value or more, the input-to-output current ratio M is kept at a constant value "1", irrespective of the drain voltage Vd of the current supply transistor Tc. In other words, the OLED element 51 is driven by the driving current Ic that is approximately equal to the data current Idata, irrespective of the drain voltage Vd of the current supply transistor Tc. Thus, according to the second embodiment, an actual luminance of the OLED element 51 is approximately equal to an intended luminance designated by the data current Idata.

B-2b: Modifications of Second Embodiment (1) First Modification

Figure 6:
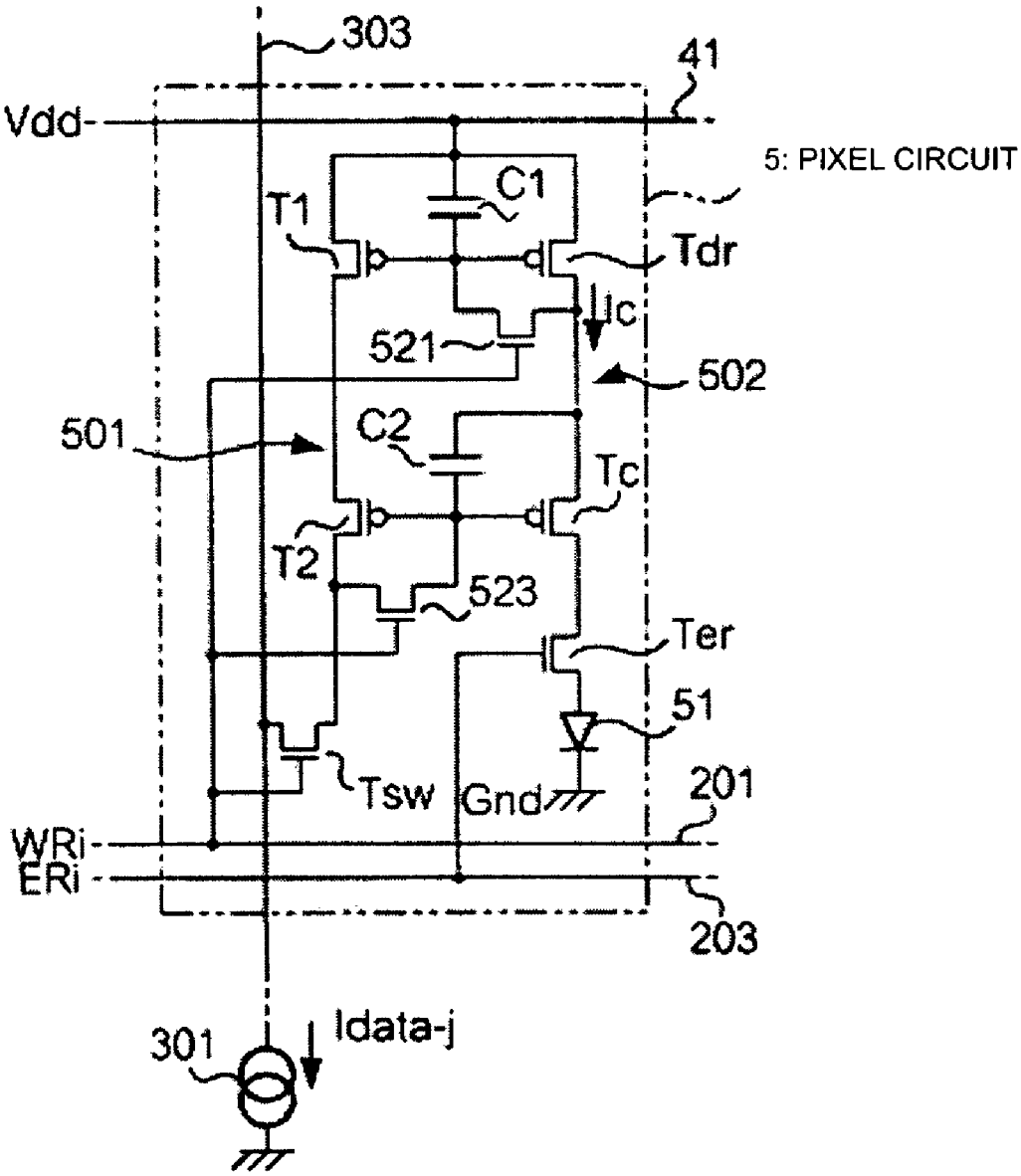
FIG. 6 is a circuit diagram showing the arrangement of a pixel circuit according to a modification of the second embodiment.

A pixel circuit 5 shown in FIG. 6 includes a p-channel transistor T2 and an n-channel transistor 523, in place of the transistor 522 of the pixel circuit 5 shown in FIG. 5. The transistor size (channel width and channel length) of the transistor T2 is approximately the same as the transistor size of the driving transistor Tdr, the current supply transistor Tc, and the transistor T1. The transistor T2 is arranged in the path 501 and generates a gate voltage corresponding to the data current Idata-j flowing in the path 501. The gate of the transistor T2 is connected to the gate of the current supply transistor Tc, which is connected to one end of the capacitor C2. The transistor 523 is a switching element for electrically connecting or disconnecting the gate and the drain of the transistor T2 in accordance with a write signal WRi. The gate of the transistor 523 is connected to the selection line 201. Thus, when the write signal WRi is shifted to an active level and the transistor 523 is turned on, the transistor T2 is diode-connected. The relationship of the drain voltage Vd of the current supply transistor Tc and the input-to-output current ratio M is similar to that shown by the solid line in FIG. 14.

(2) Second Modification

Figure 7:
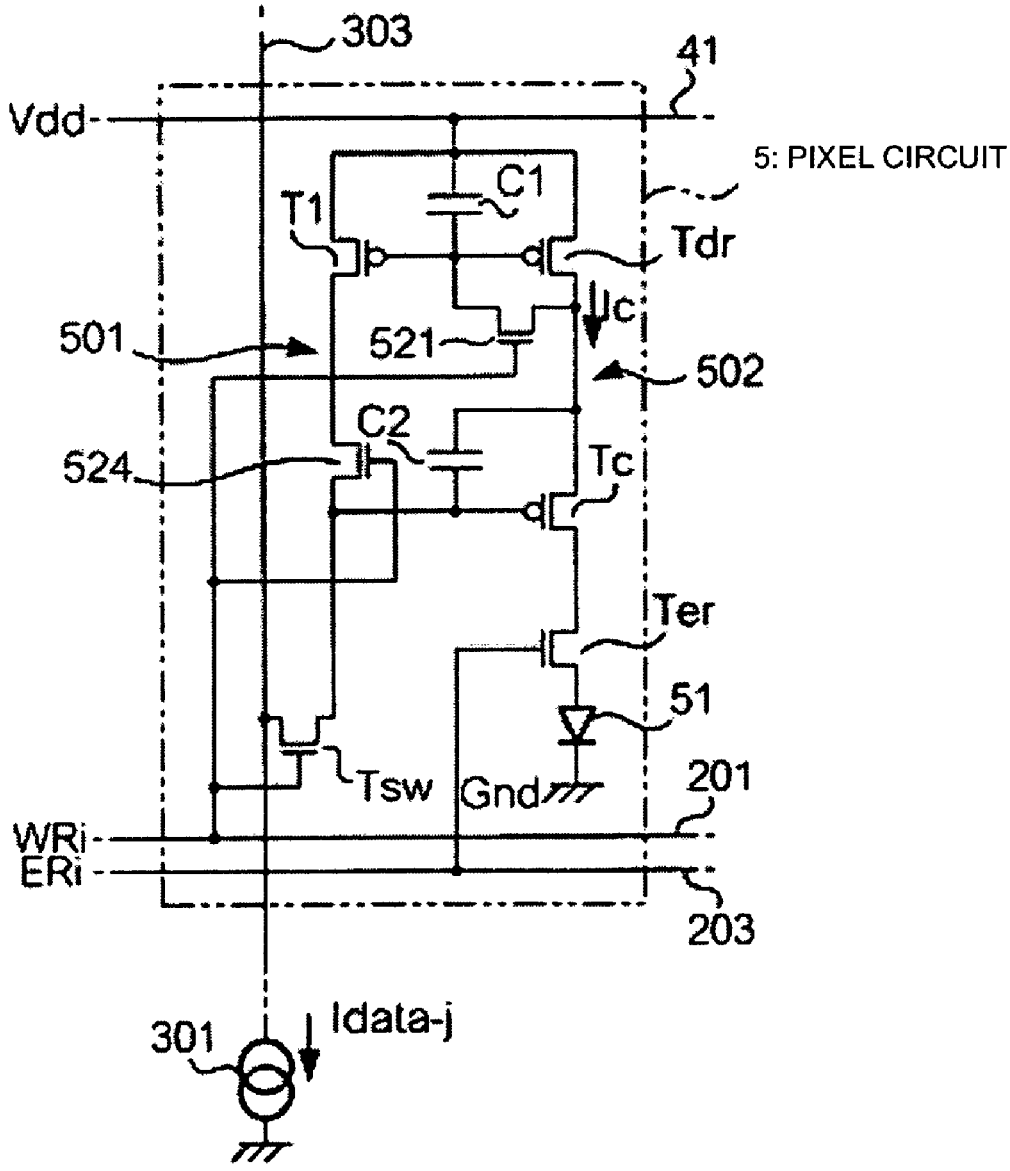
FIG. 7 is a circuit diagram showing the arrangement of a pixel circuit according to another modification of the second embodiment.

Although the pixel circuit 5 according to the second embodiment shown in FIG. 5 has an arrangement in which the transistor 522 is arranged between the gate of the current supply transistor Tc and the path 501, an arrangement shown in FIG. 7 may be adopted. In the pixel circuit 5 shown in FIG. 7, the gate of the current supply transistor Tc is directly (in other words, without a transistor arranged therebetween) connected to the path 501. Instead of providing a transistor between the gate of the current supply transistor Tc and the path 501, a transistor 524 whose gate is connected to the selection line 201 is arranged in the path 501, so that the path 501 is electrically connected or disconnected (in other words, the data current Idata is caused to flow or not to flow) in accordance with the write signal WRi. The pixel circuit 5 according to this modification has an effect similar to that in the second embodiment.

(3) Third Modification

Figure 8:
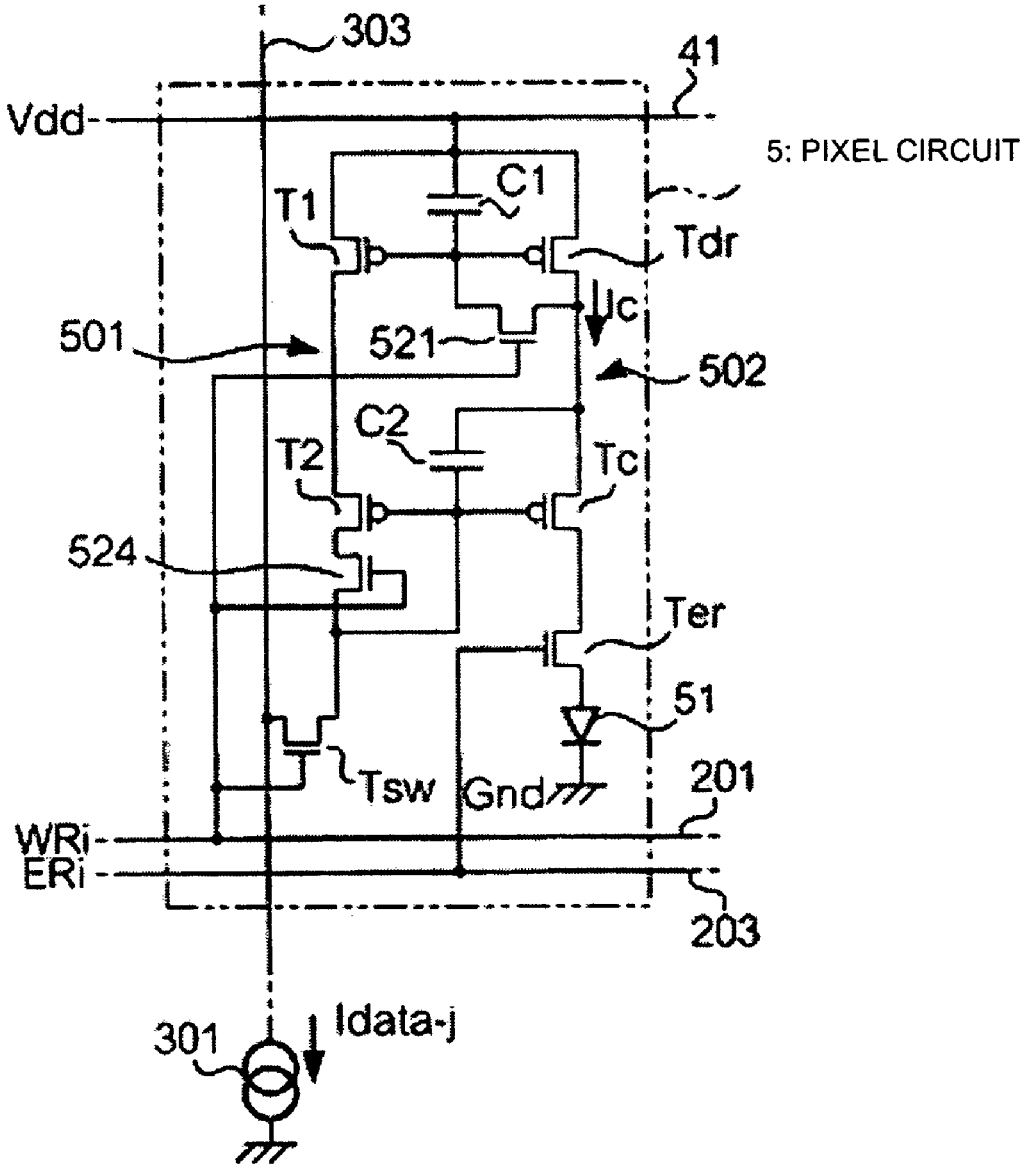
FIG. 8 is a circuit diagram showing the arrangement of a pixel circuit according to another modification of the second embodiment.

Although the pixel circuit 5 shown in FIG. 6 has an arrangement in which the transistor 523 is arranged between the gate and the drain of the transistor T2, an arrangement using the transistor 524 as in FIG. 7 may be adopted in this arrangement. In other words, in a pixel circuit 5 shown in FIG. 8, the gate of the transistor T2 and the gate of the current supply transistor Tc are connected directly to the path 501, and the transistor 524 whose gate is connected to the selection line 201 is arranged in the path 501. Thus, the path 501 is electrically connected or disconnected (in other words, the transistor T2 is diode-connected or not diode-connected) in accordance with the write signal WRi. The pixel circuit 5 according to this modification has an effect similar to that in the second embodiment.

B-3a: Third Embodiment

Figure 9:
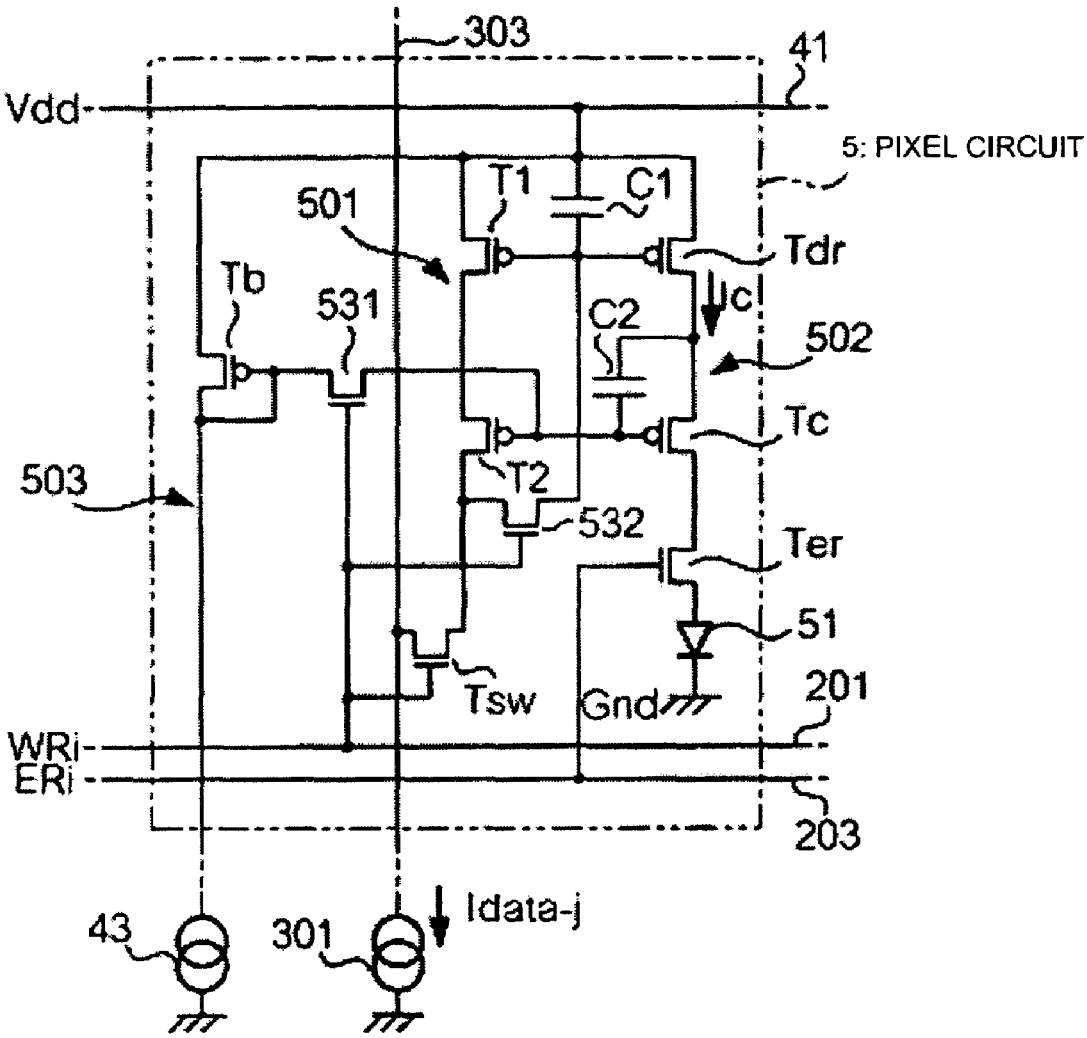
FIG. 9 is a circuit diagram showing the arrangement of a pixel circuit according to a third embodiment of the present invention.

The arrangement of pixel circuits 5 according to a third embodiment of the present invention will be described with reference to FIG. 9. Although only one pixel circuit 5 in the i-th row and the j-th column is illustrated in FIG. 9, other pixel circuits 5 have a similar arrangement. As shown in FIG. 9, the pixel circuit 5 includes the OLED element 51, which is an electro-optical element; transistors Ter, Tsw, Tdr, Tc, T1, T2, 531, 532, and Tb; and capacitors C1 and C2 functioning as voltage holding elements. Each of the transistors constituting the pixel circuit 5 is a thin-film transistor made by a polysilicon process. The transistors Tdr, Tc, T1, T2, and Th are p-channel transistors, and the transistors Ter, Tsw, 531, and 532 are n-channel transistors. The conduction type of each of the transistors constituting the pixel circuit 5 may be appropriately changed. Also, the transistors Tdr, Tc, T1, and T2 have approximately the same transistor size (channel width and channel length).

The lighting control transistor Ter is arranged in the path 502 from the power line 41 to the OLED element 51. More specifically, the source of the lighting control transistor Ter is connected to the anode of the OLED element 51, and the gate of the lighting control transistor Ter is connected to the lighting control line 203. The cathode of the OLED element 51 is grounded at a low-potential voltage Gnd of the power supply. Also, the driving transistor Tdr and the current supply transistor Tc are arranged in the path 502. The driving transistor Tdr and the current supply transistor Tc control a driving current Ic flowing into the OLED element 51. The drain of the current supply transistor Tc is connected to the drain of the lighting control transistor Ter, and the source of the current supply transistor Tc is connected to the drain of the driving transistor Tdr. The source of the driving transistor Tdr is connected to the power line 41 of the power supply. Accordingly, the driving transistor Tdr, the current supply transistor Tc, and the lighting control transistor Ter are arranged in that order in the path 502, which is from the power line 41 to the OLED element 51, when viewed from the power line 41.

The switching transistor Tsw is arranged in the path 501 from the power line 41 to the data line 303. The source of the switching transistor Tsw is connected to the data line 303, and the gate of the switching transistor Tsw is connected to the selection line 201. The transistors T1 and T2 are arranged in the path 501. The drain of the transistor T2 is connected to the drain of the switching transistor Tsw, and the source of the transistor T2 is connected to the drain of the transistor T1. The source of the transistor T1 is connected to the power line 41. Accordingly, the transistor T1, the transistor T2, and the switching transistor Tsw are arranged in that order in the path 501, which is from the power line 41 to the data line 303, when viewed from the power line 41.

The gate of the current supply transistor Tc is connected to the gate of the transistor T2. Similarly, the gate of the driving transistor Tdr is connected to the gate of the transistor T1. The gates of the transistor T1 and the driving transistor Tdr are connected to the path 501 via the transistor 532. The gate of the transistor 532 is connected to the selection line 201. The transistor 532 functions as a switching element for electrically connecting or disconnecting the gate of the transistor T1 and the path 501 in accordance with a write signal WRi.

The capacitors C1 and C2 are elements for holding a voltage corresponding to a data current Idata-j flowing to the constant-current circuit 301 from the power line 41 via the path 501 and the data line 303. One end of the capacitor C1 is connected to the gates of the driving transistor Tdr and the transistor T1, and the other end of the capacitor C1 is connected to the source of the driving transistor Tdr (thus, to the power line 41). One end of the capacitor C2 is connected to the gates of the current supply transistor Tc and the transistor T2, and the other end of the capacitor C2 is connected to the source of the current supply transistor Tc.

With this arrangement, when the write signal WRi is shifted to an active level at a horizontal scanning period during which the i-th selection line 201 is selected and the switching transistor Tsw and the transistor 532 are turned on, a data current Idata-j generated in the constant-current circuit 301 flows to the data line 303 via the path 501. Here, the gate voltages of the transistors T1 and T2 become a voltage corresponding to the data current Idata-j to be held in the capacitors C1 and C2, respectively. When the write signal WRi is shifted to an inactive level (L level), the switching transistor Tsw and the transistor 532 are turned off, and the path 501 is electrically disconnected from the data line 303. The gate voltages of the driving transistor Tdr and the current supply transistor Tc are kept at a voltage corresponding to the data current Idata-j by the capacitors C1 and C2, respectively. Thus, in this state, when the lighting control signal ERi is shifted to an active level and the lighting control transistor Ter is turned on, a driving current Ic corresponding to the data current Idata-j flows to the OLED element 51 via the path 502. This causes the OLED element 51 to emit light. As described above, in the pixel circuit 5, the driving current Ic corresponding to the data current Idata-j of the path 501 flows in the path 502. In other words, although a period at which the data current Idata-j flows is different from a period at which the driving current Ic flows, the driving transistor Tdr, the current supply transistor Tc, the transistor T1, and the transistor T2 can be regarded as substantially functioning as a cascode current mirror circuit.

The relationship of the drain voltage Vd of the current supply transistor Tc and the input-to-output current ratio M (=driving current Ic/data current Idata) in the third embodiment is also shown by the solid line in FIG. 14. As shown in FIG. 14, if the drain voltage Vd of the current supply transistor Tc is a predetermined value or more, the input-to-output current ratio M is kept at a constant value "1", irrespective of the drain voltage Vd of the current supply transistor Tc. In other words, the OLED element 51 is driven by a driving current Ic that is approximately equal to the data current Idata, irrespective of the drain voltage Vd of the current supply transistor Tc. Thus, according to the third embodiment, an actual luminance of the OLED element 51 is approximately equal to an intended luminance designated by the data current Idata.

In order to cause the driving transistor Tdr and the current supply transistor Tc; and the transistor T1 and the transistor T2 to function as current mirror circuits, all the transistors must operate in a saturation region. Thus, if a cascode current mirror circuit is merely adopted in the pixel circuit 5, the potential of the power line 41 (that is, the high-potential voltage Vdd of the power supply) must be set relatively high. This may prevent a reduction in the power consumption of the electro-optical device 100. In order to solve this problem, the pixel circuit 5 according to the third embodiment includes the transistors 531 and Tb, as shown in FIG. 9. The transistors 531 and Tb function as a circuit (corresponding to a "bias circuit" in the present invention) for applying a bias voltage to the gate of the current supply transistor Tc, as described below.

The transistor Tb (hereinafter, may be referred to as a "bias transistor") is arranged in a path 503 (corresponding to a "third path" in the present invention) from the power line 41 to a constant-current source 43. In other words, the drain of the bias transistor Tb is connected to the constant-current source 43, and the source of the bias transistor Tb is connected to the power line 41. The constant-current source 43 is a circuit for causing a predetermined current to flow in the path 503 (not shown in FIG. 1). The constant-current source 43 is provided for every m pixels aligned in the Y direction. Each constant-current source 43 generates a current of approximately the same size. The gate and the drain of the bias transistor Tb are diode-connected. Also, the gate of the bias transistor is connected to the gate of the current supply transistor Tc (gate of the transistor T2) via the transistor 531. The transistor 531 is a switching element for electrically connecting or disconnecting the gate of the bias transistor Th and the gate of the current supply transistor Tc in accordance with the write signal WRi. The gate of the transistor 531 is connected to the selection line 201.

With this arrangement, the gate voltage of the bias transistor Tb is a voltage corresponding to a current flowing in the path 503. When the write signal WRi is shifted to an active level and the transistor 531 is turned on, the gate voltage of the bias transistor Tb is applied as a bias voltage to the gate of the current supply transistor Tc. According to the arrangement in the third embodiment, the drain voltage of the current supply transistor Tc can be reduced compared with an arrangement in which a bias voltage is not supplied. Thus, a necessary power supply voltage can be reduced compared with an arrangement without the constant-current source 43, the bias transistor Tb, and the transistor 531. Therefore, according to the third embodiment, power consumption of the electro-optical device 100 can be reduced.

B-3b: Modifications of Third Embodiment (1) First Modification

Figure 10:
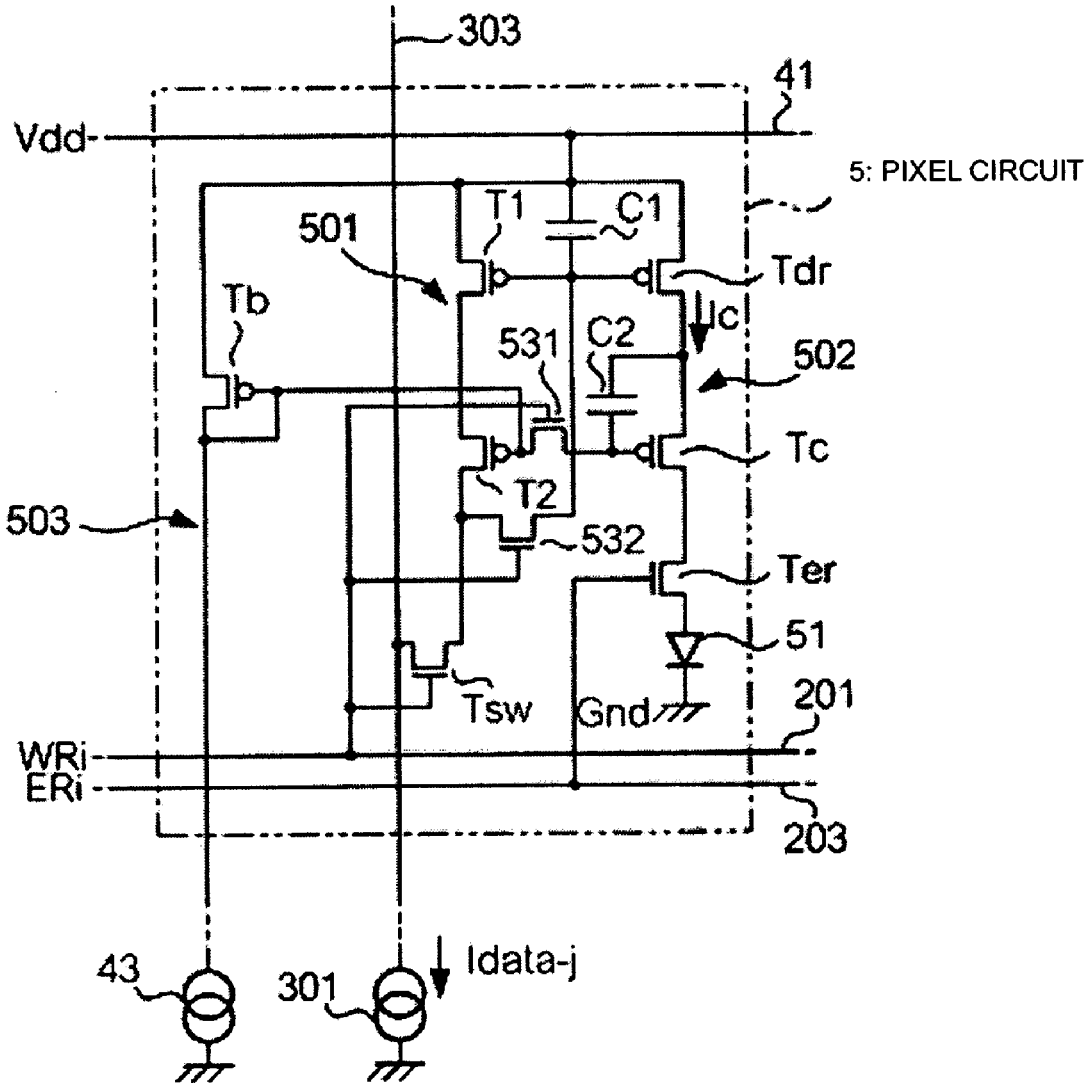
FIG. 10 is a circuit diagram showing the arrangement of a pixel circuit according to a modification of the third embodiment.
Figure 11:
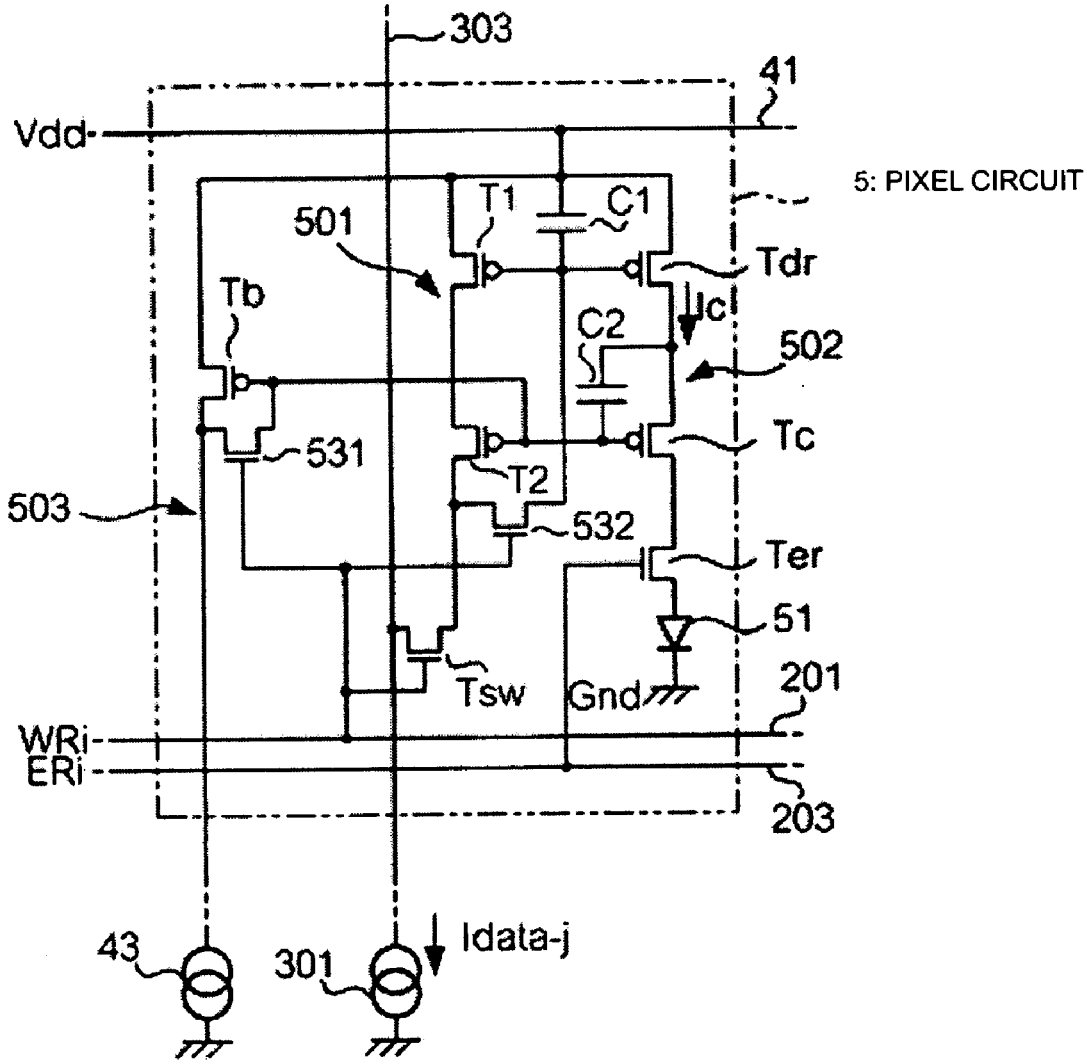
FIG. 11 is a circuit diagram showing the arrangement of a pixel circuit according to another modification of the third embodiment.

Although an arrangement in which the transistor 531 is arranged between the gate of the bias transistor Tb and the gate of the current supply transistor Tc is described in the third embodiment, an arrangement shown in FIG. 10 may be adopted instead of the arrangement described above. In the pixel circuit 5 shown in FIG. 10, the transistor 531 is arranged between the gate of the transistor T2 and the gate of the current supply transistor Tc, and the gate of the transistor T2 is connected to the gate of the bias transistor Tb. With this arrangement, only when the transistor 531 is turned on in accordance with the write signal WRi (in other words, only during a write period), the gate of the bias transistor Tb is electrically connected to the gate of the current supply transistor Tc. Thus, an effect similar to that in the third embodiment can be achieved. Also, instead of the arrangement shown in FIG. 9, the transistor 531 may be arranged between the gate and the drain of the bias transistor Tb, as shown in FIG. 11. According to the pixel circuit 5 shown in FIG. 11, since the bias transistor Tb is diode-connected only when the transistor 531 is turned on in accordance with the write signal WRi (in other words, only during the write period), a bias voltage is applied to the gate of the current supply transistor Tc only during the write period as in the embodiments described above. An effect similar to that in the third embodiment can be achieved by the arrangement described above. Furthermore, an arrangement in which the gate of the bias transistor Tb is connected directly to the gate of the current supply transistor Tc without providing the transistor 531 can also be adopted.

(2) Second Modification

Figure 12:
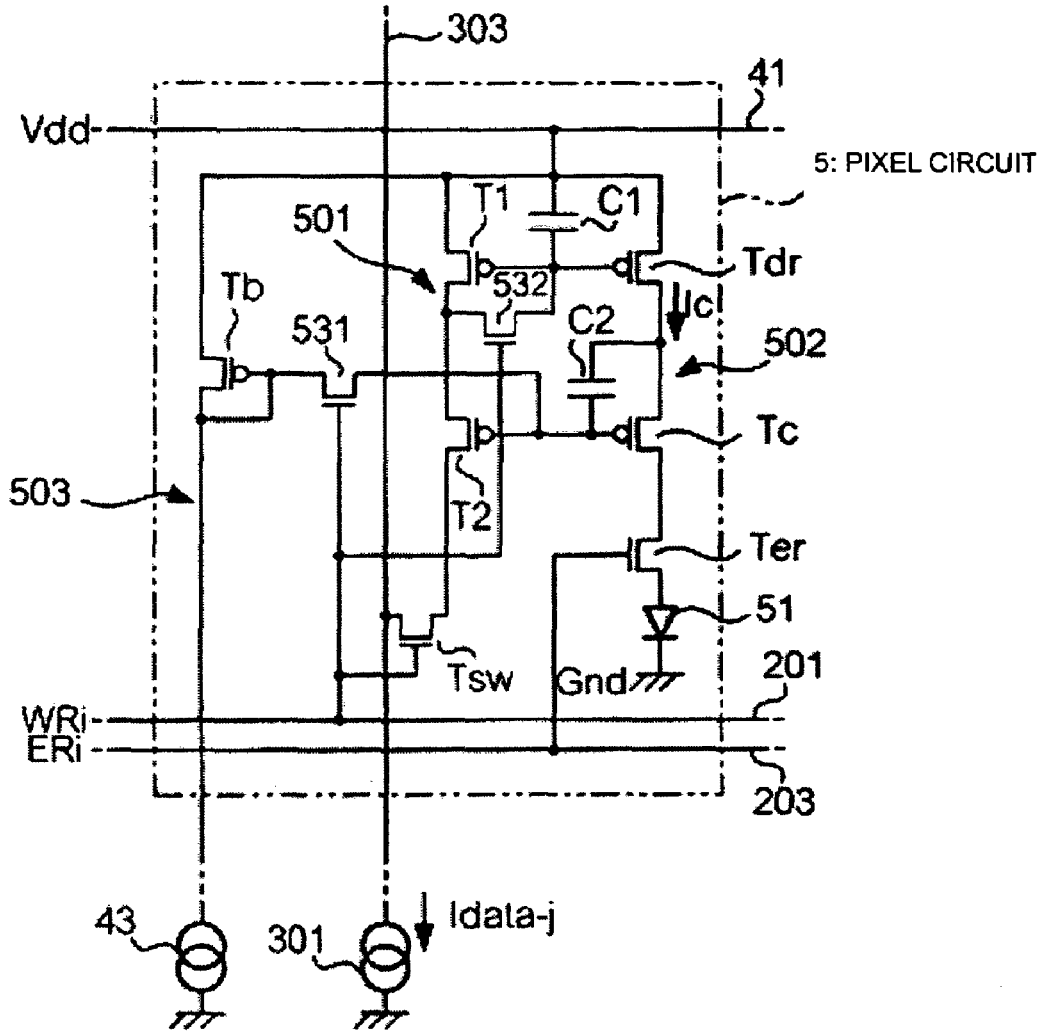
FIG. 12 is a circuit diagram showing the arrangement of a pixel circuit according to another modification of the third embodiment.

Although the transistor 532 is arranged between the gate of the transistor T1 and the drain of the transistor T2 in FIG. 9, an arrangement shown in FIG. 12 may be adopted instead of the arrangement described above. In the pixel circuit 5 shown in FIG. 12, the transistor 532 is arranged between the gate and the drain of the transistor T1. When the transistor 532 is turned on, the transistor T1 is diode-connected. An effect similar to that in the third embodiment can also be achieved by the arrangement according to this modification.

(3) Third Modification

Figure 13:
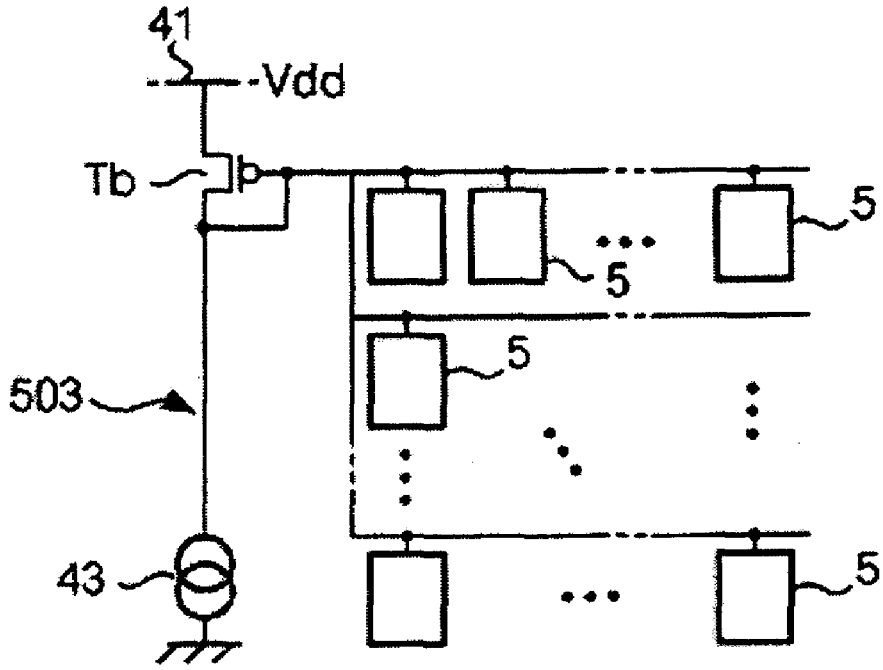
FIG. 13 is a circuit diagram showing the arrangement of a pixel circuit according to another modification of the third embodiment.

Although an arrangement in which the bias transistor Tb is provided for each of the pixel circuits 5 is described in the third embodiment, a bias transistor Tb may be commonly used for supplying a bias voltage to a plurality of pixel circuits 5. For example, as shown in FIG. 13, the gate voltage of the bias transistor Tb may be supplied as a common bias voltage to a plurality of pixel circuits 5 via wiring that connects the gate of the bias transistor Tb arranged in the path 503, which is from the power line 41 to the constant-current source 43, to the plurality of pixel circuits 5. In FIG. 13, elements irrelevant to application of a bias voltage, such as the selection line 201 and the data line 303, are omitted. Also, although the constant-current source 43 and the bias transistor Tb are used as means for generating a bias voltage in the arrangement according to the third embodiment or the arrangement shown in FIG. 13, an arrangement for generating a bias voltage is optional. For example, an arrangement in which a voltage generated by a constant-voltage source is supplied as a bias voltage to each of the pixel circuits 5 may be adopted.

C: Other Modifications

Various modifications can be made to each of the embodiments described above.

(1) Although an arrangement in which one end of the capacitor C1 is connected to the source of the driving transistor Tdr (that is, to the power line 41) and one end of the capacitor C2 is connected to the source of the current supply transistor Tc is described in each of the embodiments, the one end of each of the capacitors C1 and C2 may be connected to other points. In short, it is sufficient that one end of each of the capacitors C1 and C2 is connected to a point to which a substantially constant voltage is applied and that the gate voltages of the transistor T1 (or the driving transistor Tdr) and the transistor T2 (or the current supply transistor Tc) are held in the capacitors C1 and C2, respectively.

(2) Although an arrangement in which the lighting control signal ERi defines a period during which the OLED element 51 emits light is described in the embodiments described above, the lighting control line 203 and the lighting control transistor Ter controlled by the lighting control line 203 are not essential. For example, the drain of the current supply transistor Tc may be directly connected to the anode of the OLED element 51. With this arrangement, the driving current Ic flows to the OLED element 51 even during a write period, thus causing the OLED element 51 to emit light.

(3) The present invention is also applicable to an electro-optical device using an electro-optical element other than an OLED element. For example, the present invention is applicable to an electro-optical device for displaying images using a light-emitting diode (LED) as an electro-optical element. According to the present invention, the input-to-output current ratio M is kept substantially constant, irrespective of the voltage of an electro-optical element. Thus, the present invention is particularly suitable for an electro-optical device using an electro-optical element driven by current (a so-called current-driven electro-optical element).

D: Electronic Apparatus

Figure 15:
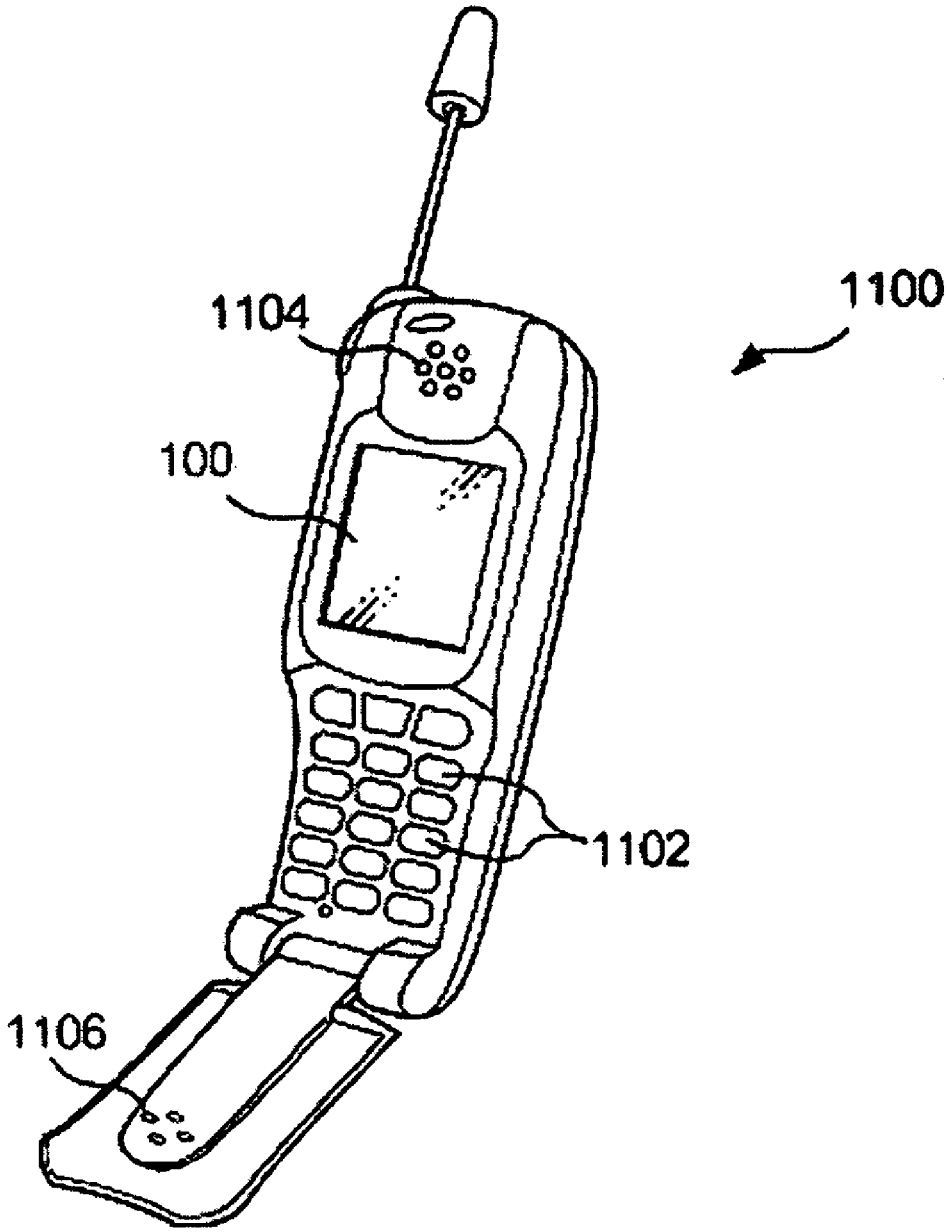
FIG. 15 is a perspective view showing the configuration of a cellular telephone set, which is an example of an electronic apparatus according to the present invention.

An electronic apparatus including an electro-optical device according to the present invention as a display unit will be described. FIG. 15 is a perspective view showing the configuration of a cellular telephone set 1100 including an electro-optical device according to the present invention as a display device. As shown in FIG. 15, the cellular telephone set 1100 includes the electro-optical device 100 according to any one of the embodiments described above, as well as a plurality of operation buttons 1102 operated by a user, a earpiece 1104 for outputting voice received from other terminal apparatuses, and a mouthpiece 1106 for inputting voice to be transmitted to other terminal apparatuses.

The electronic apparatus in which an electro-optical device according to the present invention can be used may be a notebook computer, a liquid crystal television set, a viewfinder-type (or monitor direct-view-type) video recorder, a digital camera, a car navigation apparatus, a pager, an electronic notebook, an electronic calculator, a word-processor, a workstation, a television telephone set, a point-of-sale (POS) terminal, an apparatus provided with a touch panel, or the like, as well as the cellular telephone set 1100 shown in FIG. 15.

What is claimed is:

1. A pixel circuit comprising:

a first path from a power supply to a current source;

a second path from the power supply to an electro-optical element;

a first transistor arranged in the first path:

a third transistor for diode-connecting the first transistor:

a first voltage holding element for holding a voltage corresponding to a data current flowing in the first path;

a driving transistor for controlling a driving current flowing in the second path in accordance with the voltage held in the first voltage holding element connected to a gate of the driving transistor, the driving transistor being arranged in the second path, the gate of the driving transistor also being connected to a gate of the first transistor;

a second transistor arranged in the first path;

a fourth transistor for diode-connecting the second transistor;

a second voltage holding element for holding a voltage corresponding to the data current flowing in the first path; and a current supply transistor for controlling the driving current flowing in the second path in accordance with the voltage held in the second voltage holding element connected to a gate of the current supply transistor, the current supply transistor being arranged in the second path, the gate of the current supply transistor also being connected to a gate of the second transistor, the first transistor and the driving transistor constituting a first current mirror circuit, the second transistor and the current supply transistor constituting a second current mirror circuit, and the first current mirror circuit and the second current mirror circuit being cascade-connected.

2. The pixel circuit according to claim 1, the second current mirror circuit functioning as maintaining means for maintaining a ratio between the data current and the driving current substantially constant, irrespective of a voltage of the electro-optical element.

3. The pixel circuit according to claim 2, further comprising:

means for causing the gate of the driving transistor to be in a floating state; and means for causing the gate of the current supply transistor to be in the floating state.

4. An electro-optical device comprising a plurality of pixel circuits as set forth in claim 1 arranged in a planar fashion.

5. An electronic apparatus comprising the electro-optical device as set forth in claim 4 as a display device.

* * * * *